US005568737A

United States Patent [19]

Campbell et al.

[11] Patent Number: 5,568,737

[45] Date of Patent: Oct. 29, 1996

[54] HYDROCARBON GAS PROCESSING

[75] Inventors: Roy E. Campbell; John D. Wilkinson; Hank M. Hudson, all of Midland, Tex.

[73] Assignee: ELCOR Corporation, Dallas, Tex.

[21] Appl. No.: 337,172

[22] Filed: Nov. 10, 1994

[51] Int. Cl.[6] ..... F25J 3/06; F25J 3/02

[52] U.S. Cl. ..... 62/621; 62/901

[58] Field of Search ..... 62/24, 28, 38, 62/23, 621, 901

[56] References Cited

U.S. PATENT DOCUMENTS

| | | | |
|---|---|---|---|
| 4,157,904 | 6/1979 | Campbell et al. | 62/27 |
| 4,171,964 | 10/1979 | Campbell et al. | 62/24 |
| 4,278,457 | 7/1981 | Campbell et al. | 62/24 |
| 4,687,499 | 8/1987 | Aghili | 62/24 |
| 4,854,955 | 8/1989 | Campbell et al. | 62/24 |
| 4,869,740 | 9/1989 | Campbell et al. | 62/24 |
| 4,889,545 | 12/1989 | Campbell et al. | 62/24 |
| 4,895,584 | 1/1990 | Buck et al. | 62/24 X |
| 4,966,612 | 10/1990 | Bauer | 62/24 |
| 5,275,005 | 1/1994 | Campbell et al. | 62/24 |

*Primary Examiner*—Christopher Kilner
*Attorney, Agent, or Firm*—Brumbaugh, Graves, Donohue & Raymond

[57] ABSTRACT

A process for the recovery of ethane, ethylene, propane, propylene and heavier hydrocarbon components from a hydrocarbon gas stream is disclosed. The stream is divided into first and second streams. The first stream is cooled to condense substantially all of it and is thereafter expanded to the fractionation tower pressure and supplied to the fractionation tower at a first mid-column feed position. The second stream is expanded to the tower pressure and is then supplied to the column at a second mid-column feed position. A recycle stream is withdrawn from the tower overhead after it has been warmed and compressed. The compressed recycle stream is cooled sufficiently to substantially condense it, and is then expanded to the pressure of the distillation column and supplied to the column at a top column feed position. The pressure of the compressed recycle stream and the quantities and temperatures of the feeds to the column are effective to maintain the column overhead temperature at a temperature whereby the major portion of the desired components is recovered.

81 Claims, 10 Drawing Sheets

HYDROCARBON GAS PROCESSING

BACKGROUND OF THE INVENTION

This invention relates to a process for the separation of a gas containing hydrocarbons.

Ethylene, ethane, propylene, propane and heavier hydrocarbons can be recovered from a variety of gases, such as natural gas, refinery gas, and synthetic gas streams obtained from other hydrocarbon materials such as coal, crude oil, naphtha, oil shale, tar sands, and lignite. Natural gas usually has a major proportion of methane and ethane, i.e., methane and ethane together comprise at least 50 mole percent of the gas. The gas may also contain relatively lesser amounts of heavier hydrocarbons such as propane, butanes, pentanes and the like, as well as hydrogen, nitrogen, carbon dioxide and other gases.

The present invention is generally concerned with the recovery of ethylene, ethane, propylene, propane and heavier hydrocarbons from such gas streams. A typical analysis of a gas stream to be processed in accordance with this invention would be, in approximate mole percent, 92.5% methane, 4.2% ethane and other $C_2$ components, 1.3% propane and other $C_3$ components, 0.4% iso-butane, 0.3% normal butane, 0.5% pentanes plus, with the balance made up of nitrogen and carbon dioxide. Sulfur containing gases are also sometimes present.

The historically cyclic fluctuations in the prices of both natural gas and its natural gas liquid (NGL) constituents have reduced the incremental value of ethane and heavier components as liquid products. This has resulted in a demand for processes that can provide more efficient recoveries of these products. Available processes for separating these materials include those based upon cooling and refrigeration of gas, oil absorption, and refrigerated oil absorption. Additionally, cryogenic processes have become popular because of the availability of economical equipment that produces power while simultaneously expanding and extracting heat from the gas being processed. Depending upon the pressure of the gas source, the richness (ethane and heavier hydrocarbons content) of the gas, and the desired end products, each of these processes or a combination thereof may be employed.

The cryogenic expansion process is now generally preferred for ethane recovery because it provides maximum simplicity with ease of start up, operating flexibility, good efficiency, safety, and good reliability. U.S. Pat. Nos. 4,157,904, 4,171,964, 4,278,457, 4,687,499, 4,854,955, 4,869,740, and 4,889,545 describe relevant processes.

In a typical cryogenic expansion recovery process, a feed gas stream under pressure is cooled by heat exchange with other streams of the process and/or external sources of refrigeration such as a propane compression-refrigeration system. As the gas is cooled, liquids may be condensed and collected in one or more separators as high-pressure liquids containing some of the desired $C_2$+ components. Depending on the richness of the gas and the amount of liquid formed, the high-pressure liquids may be expanded to a lower pressure and fractionated. The vaporization occurring during expansion of the liquid results in further cooling of the stream. Under some conditions, pre-cooling the high pressure liquid prior to the expansion may be desirable in order to further lower the temperature resulting from the expansion. The expanded stream, comprising a mixture of liquid and vapor, is fractionated in a distillation (demethanizer) column. In the column, the expansion cooled stream(s) is (are) distilled to separate residual methane, nitrogen, and other volatile gases as overhead vapor from the desired $C_2$ components, $C_3$ components, and heavier components as bottom liquid product.

If the feed gas is not totally condensed (typically it is not), the vapor remaining from the partial condensation can be split into two or more streams. One portion of the vapor is passed through a work expansion machine or engine, or an expansion valve, to a lower pressure at which additional liquids are condensed as a result of further cooling of the stream. The pressure after expansion is essentially the same as the pressure at which the distillation column is operated. The combined vapor-liquid phases resulting from the expansion are supplied as feed to the column.

The remaining portion of the vapor is cooled to substantial condensation by heat exchange with other process streams, e.g., the cold fractionation tower overhead. Depending on the amount of high-pressure liquid available, some or all of the high-pressure liquid may be combined with this vapor portion prior to cooling. The resulting cooled stream is then expanded through an appropriate expansion device, such as an expansion valve, to the pressure at which the demethanizer is operated. During expansion, a portion of the liquid will vaporize, resulting in cooling of the total stream. The flash expanded stream is then supplied as top feed to the demethanizer. Typically, the vapor portion of the expanded stream and the demethanizer overhead vapor combine in an upper separator section in the fractionation tower as residual methane product gas. Alternatively, the cooled and expanded stream may be supplied to a separator to provide vapor and liquid streams. The vapor is combined with the tower overhead and the liquid is supplied to the column as a top column feed.

In the ideal operation of such a separation process, the residue gas leaving the process will contain substantially all of the methane in the feed gas with essentially none of the heavier hydrocarbon components and the bottoms fraction leaving the demethanizer will contain substantially all of the heavier components with essentially no methane or more volatile components. In practice, however, this ideal situation is not obtained for the reason that the conventional demethanizer is operated largely as a stripping column. The methane product of the process, therefore, typically comprises vapors leaving the top fractionation stage of the column, together with vapors not subjected to any rectification step. Considerable losses of $C_2$ components occur because the top liquid feed contains substantial quantities of $C_2$ components and heavier components, resulting in corresponding equilibrium quantities of $C_2$ components and heavier components in the vapors leaving the top fractionation stage of the demethanizer. The loss of these desirable components could be significantly reduced if the rising vapors could be brought into contact with a significant quantity of liquid (reflux), containing very little $C_2$ components and heavier components; that is, reflux capable of absorbing the $C_2$ components and heavier components from the vapors. The present invention provides the means for achieving this objective and significantly improving the recovery of the desired products.

In accordance with the present invention, it has been found that $C_2$ recoveries in excess of 96 percent can be obtained. Similarly, in those instances where recovery of $C_2$ components is not desired, $C_3$ recoveries in excess of 98% can be maintained. In addition, the present invention makes possible essentially 100 percent separation of methane (or $C_2$ components) and lighter components from the $C_2$ components (or $C_3$ components) and heavier components at reduced energy requirements. The present invention, although applicable at lower pressures and warmer temperatures, is particularly advantageous when processing feed gases in the range of 600 to 1000 psia or higher under conditions requiring column overhead temperatures of −110° F. or colder.

For a better understanding of the present invention, reference is made to the following examples and drawings. Referring to the drawings:

FIG. 1 is a flow diagram of a cryogenic expansion natural gas processing plant of the prior art according to U.S. Pat. No. 4,157,904;

FIG. 2 is a flow diagram of a cryogenic expansion natural gas processing plant of an alternative prior art system according to U.S. Pat. No. 4,687,499;

FIG. 3 is a flow diagram of a cryogenic expansion natural gas processing plant of an alternative prior art system according to U.S. Pat. No. 4,889,545;

In the following explanation of the above figures, tables are provided summarizing flow rates calculated for representative process conditions. In the tables appearing herein, the values for flow rates (in pound moles per hour) have been rounded to the nearest whole number for convenience. The total stream rates shown in the tables include all nonhydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and on that is typically made by those skilled in the art.

DESCRIPTION OF THE PRIOR ART

Figure 1:
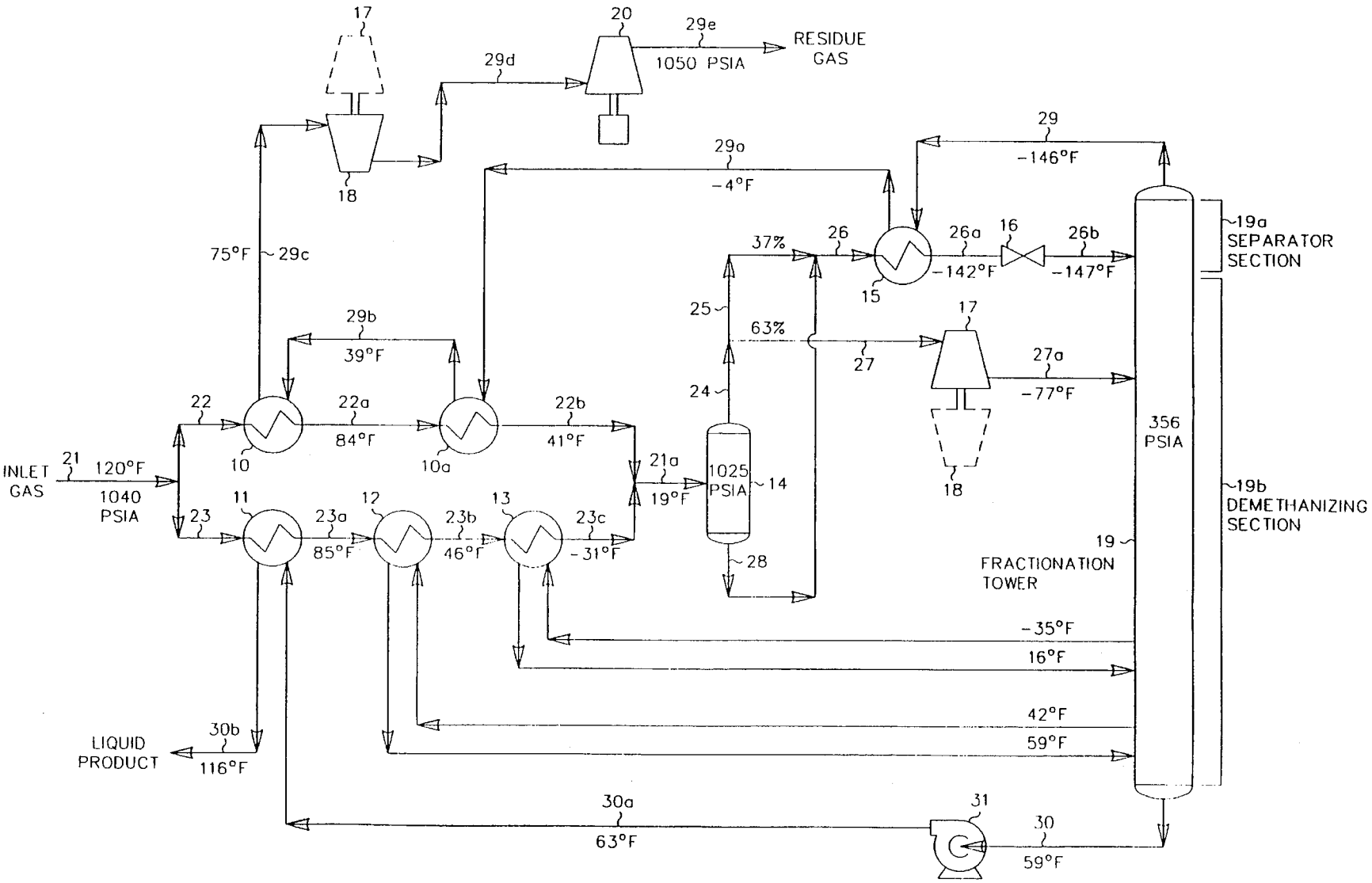
FIG. 1 (PRIOR ART)

Referring now to FIG. 1, in a simulation of the process according to U.S. Pat. No. 4,157,904, inlet gas enters the plant at 120° F. and 1040 psia as stream 21. If the inlet gas contains a concentration of sulfur compounds which would prevent the product streams from meeting specifications, the sulfur compounds are removed by appropriate pretreatment of the feed gas (not illustrated). In addition, the feed stream is usually dehydrated to prevent hydrate (ice) formation under cryogenic conditions. Solid desiccant has typically been used for this purpose.

The feed stream is divided into two parallel streams, 22 and 23. The upper stream, 22, is cooled to 41° F. (stream **22*b*) by heat exchange with cool residue gas at −4° F. in exchangers 10 and 10*a***. (The decision as to whether to use more than one heat exchanger for the indicated cooling service will depend on a number of factors including, but not limited to, inlet gas flow rate, heat exchanger size, residue gas temperature, etc.)

The lower stream, 23, is cooled to 85° F. by heat exchange with bottom liquid product (stream **30*a*) from the demethanizer bottoms pump, 31, in exchanger 11. The cooled stream, 23*a*, is further cooled to 46° F. (stream 23*b*) by demethanizer liquid at 42° F. in demethanizer reboiler 12, and to −31° F. (stream 23*c*) by demethanizer liquid in demethanizer side reboiler 13**.

Following cooling, the two streams, **22*b* and 23*c*, recombine as stream 21*a*. The recombined stream then enters separator 14 at 19° F. and 1025 psia where the vapor (stream 24) is separated from the condensed liquid (stream 28**).

The vapor (stream 24) from separator 14 is divided into two streams, 25 and 27. Stream 25, containing about 37% of the total vapor, is combined with the separator liquid (stream 28). The combined stream 26 then passes through heat exchanger 15 in heat exchange relation with the demethanizer overhead vapor stream 29 resulting in cooling and substantial condensation of the combined stream. The substantially condensed stream **26*a* at −142° F. is then flash expanded through an appropriate expansion device, such as expansion valve 16, to the operating pressure (approximately 356 psia) of the fractionation tower 19. During expansion a portion of the stream is vaporized, resulting in cooling of the total stream. In the process illustrated in FIG. 1, the expanded stream 26*b* leaving expansion valve 16 reaches a temperature of −147° F., and is supplied to separator section 19*a* in the upper region of fractionation tower 19. The liquids separated therein become the top feed to demethanizing section 19*b***.

The remaining 63% of the vapor from separator 14 (stream 27) enters a work expansion machine 17 in which mechanical energy is extracted from this portion of the high pressure feed. The machine 17 expands the vapor substantially isentropically from a pressure of about 1025 psia to a pressure of about 356 psia, with the work expansion cooling the expanded stream **27*a* to a temperature of approximately −77° F. The typical commercially available expanders are capable of recovering on the order of 80–85% of the work theoretically available in an ideal isentropic expansion. The work recovered is often used to drive a centrifugal compressor (such as item 18), that can be used to re-compress the residue gas (stream 29*c*), for example. The expanded and partially condensed stream 27*a*** is supplied as feed to the distillation column at an intermediate point.

The demethanizer in fractionation tower 19 is a conventional distillation column containing a plurality of vertically spaced trays, one or more packed beds, or some combination of trays and packing. As is often the case in natural gas processing plants, the fractionation tower may consist of two sections. The upper section **19*a* is a separator wherein the partially vaporized top feed is divided into its respective vapor and liquid portions, and wherein the vapor rising from the lower distillation or demethanizing section 19*b* is combined with the vapor portion of the top feed to form the cold residue gas distillation stream 29 which exits the top of the tower. The lower, demethanizing section 19*b*** contains the trays and/or packing and provides the necessary contact between the liquids falling downward and the vapors rising upward. The demethanizing section also includes reboilers which heat and vaporize a portion of the liquids flowing down the column to provide the stripping vapors which flow up the column.

The liquid product stream 30 exits the bottom of the tower at 59° F., based on a typical specification of a methane to ethane ratio of 0.025:1 on a molar basis in the bottom product. The stream is pumped to approximately 650 psia, stream 30*a*, in pump 31. Stream 30*a*, now at about 63° F., is warmed to 116° F. (stream 30*b*) in exchanger 11 as it provides cooling to stream 23. (The discharge pressure of the pump is usually set by the ultimate destination of the liquid product. Generally the liquid product flows to storage and the pump discharge pressure is set so as to prevent any vaporization of stream 30*b* as it is warmed in exchanger 11.)

The residue gas (stream 29) passes countercurrently to the incoming feed gas in: (a) heat exchanger 15 where it is heated to −4° F. (stream 29*a*), (b) heat exchanger 10*a* where it is heated to 39° F. (stream 29*b*), and (c) heat exchanger 10 where it is heated to 75° F. (stream 29*c*). The residue gas is then re-compressed in two stages. The first stage is compressor 18 driven by expansion machine 17. The second stage is compressor 20 driven by a supplemental power source which compresses the residue gas to 1050 psia (stream 29*e*), sufficient to meet line requirements (usually on the order of the inlet pressure).

A summary of stream flow rates and energy consumption for the process illustrated in FIG. 1 is set forth in the following table:

TABLE I (FIG. 1)
Stream Flow Summary - (Lb. Moles/Hr)

| Stream | Methane | Ethane | Propane | Butanes+ | Total |
|---|---|---|---|---|---|
| 21 | 25382 | 1161 | 362 | 332 | 27448 |
| 24 | 25337 | 1152 | 354 | 275 | 27329 |
| 28 | 45 | 9 | 8 | 57 | 119 |
| 25 | 9392 | 427 | 131 | 102 | 10131 |
| 27 | 15945 | 725 | 223 | 173 | 17198 |
| 29 | 25356 | 102 | 5 | 1 | 25589 |
| 30 | 26 | 1059 | 357 | 331 | 1859 |
| | Recoveries* | | | | |
| | Ethane | | | 91.24% | |
| | Propane | | | 98.66% | |
| | Butanes+ | | | 99.81% | |
| | Horsepower | | | | |
| | Residue Compression | | | 13,850 | |

*(Based on un-rounded flow rates)

The prior art illustrated in FIG. 1 is limited to the ethane recovery shown in Table I by the equilibrium at the top of the column with the top feed to the demethanizer. Lowering the feed gas temperature at separator 14 below that shown in FIG. 1 will not increase the recovery appreciably, but will only reduce the power recovered in expansion machine 17 and increase the residue compression horsepower correspondingly. The only way to significantly improve the ethane recovery of the prior art process of FIG. 1 is to lower the operating pressure of the demethanizer, but to do so will increase the residue compression horsepower inordinately. Even so, the ultimate ethane recovery possible will still be dictated by the composition of the top liquid feed to the demethanizer.

Figure 2:
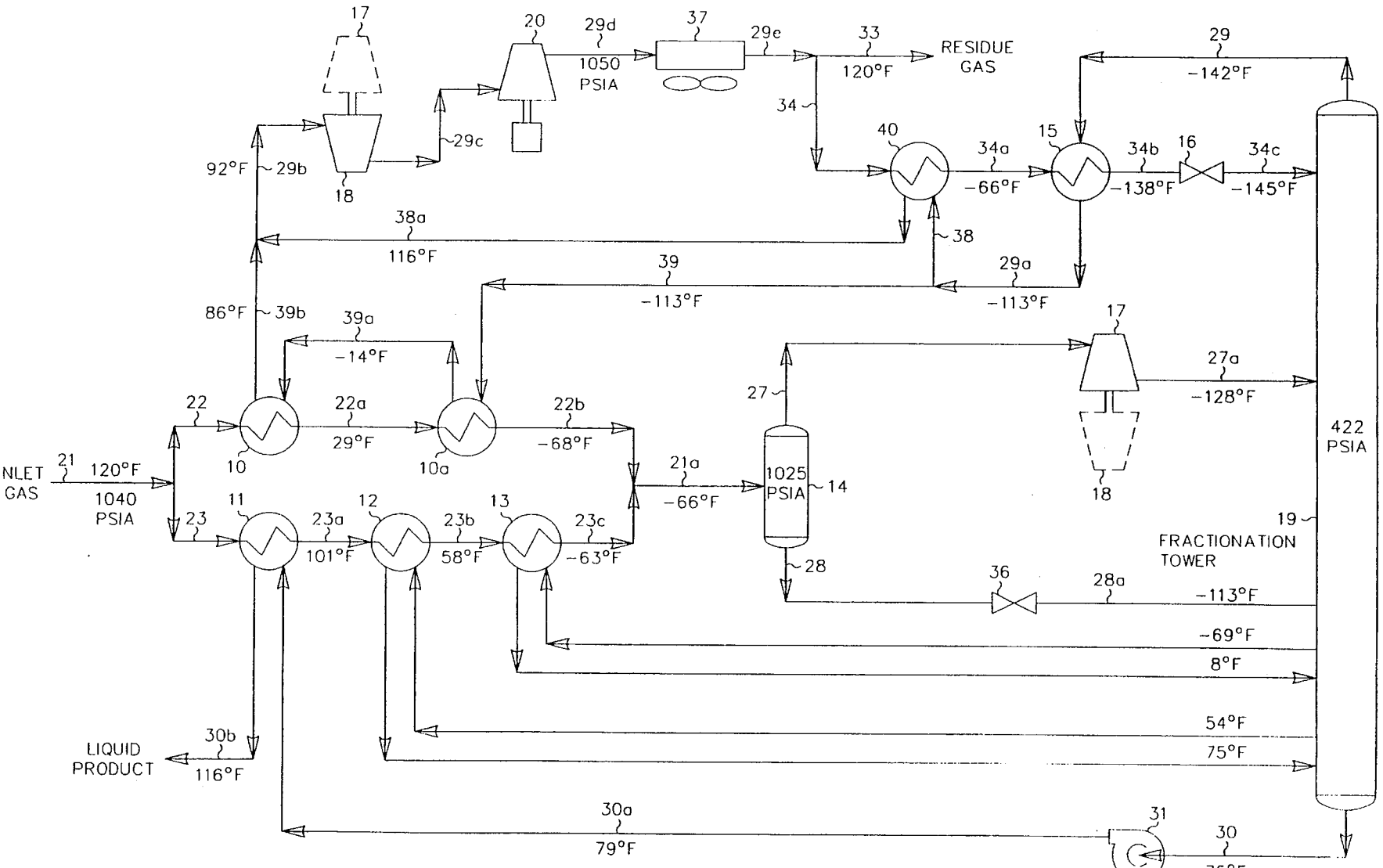
FIG. 2 (PRIOR ART)

One way to achieve higher ethane recovery without lowering the demethanizer operating pressure is to create a leaner (lower $C_2$+ content) top (reflux) feed. FIG. 2 represents an alternative prior art process in accordance with U.S. Pat. No. 4,687,499 that recycles a portion of the residue gas product to provide a leaner top feed to the demethanizer. The process of FIG. 2 has been applied to the same feed gas composition and conditions as described above for FIG. 1. In the simulation of this process, as in the simulation for the process of FIG. 1, operating conditions were selected to minimize energy consumption for a given recovery level. The feed stream is divided into two parallel streams, 22 and 23. The upper stream, 22, is cooled to −68° F. (stream 22*b*) by heat exchange with a portion of the cool residue gas at −113° F. (stream 39) in exchangers 10 and 10*a*.

The lower stream, 23, is cooled to 101° F. by heat exchange with bottom liquid product at 79° F. (stream 30*a*) from the demethanizer bottoms pump, 31, in exchanger 11. The cooled stream, 23*a*, is further cooled to 58° F. (stream 23*b*) by demethanizer liquid at 54° F. in demethanizer reboiler 12, and to −63° F. (stream 23*c*) by demethanizer liquid at −69° F. in demethanizer side reboiler 13.

Following cooling, the two streams, 22*b* and 23*c*, recombine as stream 21*a*. The recombined stream then enters separator 14 at −66° F. and 1025 psia where the vapor (stream 27) is separated from the condensed liquid (stream 28).

The vapor from separator 14 (stream 27) enters a work expansion machine 17 in which mechanical energy is extracted from this portion of the high pressure feed. The machine 17 expands the vapor substantially isentropically from a pressure of about 1025 psia to the operating pressure of the demethanizer of about 422 psia, with the work expansion cooling the expanded stream to a temperature of approximately −128° F. The expanded and partially condensed stream 27*a* is supplied as feed to the distillation column at an intermediate point. The separator liquid (stream 28) is likewise expanded to 422 psia by expansion valve 36, cooling stream 28 to −113° F. (stream 28*a*) before it is supplied to the demethanizer in fractionation tower 19 at a lower mid-column feed point.

A portion of the high pressure residue gas (stream 34) is withdrawn from the main residue flow (stream 29*e*) to become the top distillation column feed. Recycle gas stream 34 passes through heat exchanger 40 in heat exchange relation with a portion of the cool residue gas (stream 38) where it is cooled to −66° F. (stream 34*a*). Cooled recycle stream 34*a* then passes through heat exchanger 15 in heat exchange relation with the cold demethanizer overhead distillation vapor stream 29 resulting in further cooling and substantial condensation of the recycle stream. The further cooled stream 34*b* at −138° F. is then expanded through an appropriate expansion device, such as expansion valve 16. As the stream is expanded to 422 psia, it is cooled to a temperature of approximately −145° F. (stream 34*c*). The expanded stream 34*c* is supplied to the tower as the top feed.

The liquid product Stream 30 exits the bottom of tower 19 at 75° F. This stream is pumped to approximately 655 psia, stream 30*a*, in pump 31. Stream 30*a*, now at 79° F., is warmed to 116° F. (stream 30*b*) in exchanger 11 as it provides cooling to stream 23.

The cold residue gas (stream 29) at a temperature of −142° F. passes countercurrently to the recycle gas stream in heat exchanger 15 where it is warmed to −113° F. (stream 29*a*). The warmed residue gas is then divided into two portions, streams 38 and 39. One portion, stream 38, passes countercurrently to the recycle stream 34 in heat exchanger 40 where it is heated to 116° F. (stream 38*a*). The other portion, stream 39, passes countercurrently to the incoming feed gas in heat exchanger 10*a* where it is heated to −14° F.

(stream 39*a*) and in heat exchanger 10 where it is heated to 86° F. (stream 39*b*). The two heated streams then recombine to form the warm residue gas stream 29*b* at 92° F. The recombined warm residue gas is then re-compressed in two stages. The first stage is compressor 18 driven by expansion machine 17. The second stage is compressor 20 driven by a supplemental power source which compresses the residue gas to 1050 psia (stream 29*d*). After stream 29*d* is cooled to 120° F. (stream 29*e*) by heat exchanger 37, the recycle stream 34 is withdrawn and the residue gas product (stream 33) flows to the sales pipeline.

A summary of stream flow rates and energy consumption for the process illustrated in FIG. 2 is set forth in the following table:

TABLE II (FIG. 2)
Stream Flow Summary - (Lb. Moles/Hr)

| Stream | Methane | Ethane | Propane | Butanes+ | Total |
|---|---|---|---|---|---|
| 21 | 25382 | 1161 | 362 | 332 | 27448 |
| 27 | 24296 | 1025 | 281 | 171 | 25972 |
| 28 | 1086 | 136 | 81 | 161 | 1476 |
| 34 | 6391 | 8 | 0 | 0 | 6431 |
| 29 | 31746 | 39 | 0 | 0 | 31945 |
| 30 | 27 | 1130 | 362 | 332 | 1934 |
| 33 | 25355 | 31 | 0 | 0 | 25514 |
| | Recoveries* | | | | |
| | Ethane | | | 97.31% | |
| | Propane | | | 100.00% | |
| | Butanes+ | | | 100.00% | |
| | Horsepower | | | | |
| | Residue Compression | | | 16,067 | |

*(Based on un-rounded flow rates)

Comparison of the recovery levels displayed in Tables I and II shows that the leaner top column feed in the FIG. 2 process created by recycling a portion of the column overhead stream provides a substantial improvement in liquids recovery. The FIG. 2 process improves ethane recovery from 91.24% to 97.31%, propane recovery from 98.66% to 100.00%, and butanes+ recovery from 99.81% to 100.00%. However, the horsepower (utility) requirement of the FIG. 2 process is more than 16 percent higher than that of the FIG. 1 process. This means that the liquid recovery efficiency of the FIG. 2 process is about 8 percent lower than the FIG. 1 process (in terms of ethane recovered per unit of horsepower expended).

Figure 3:
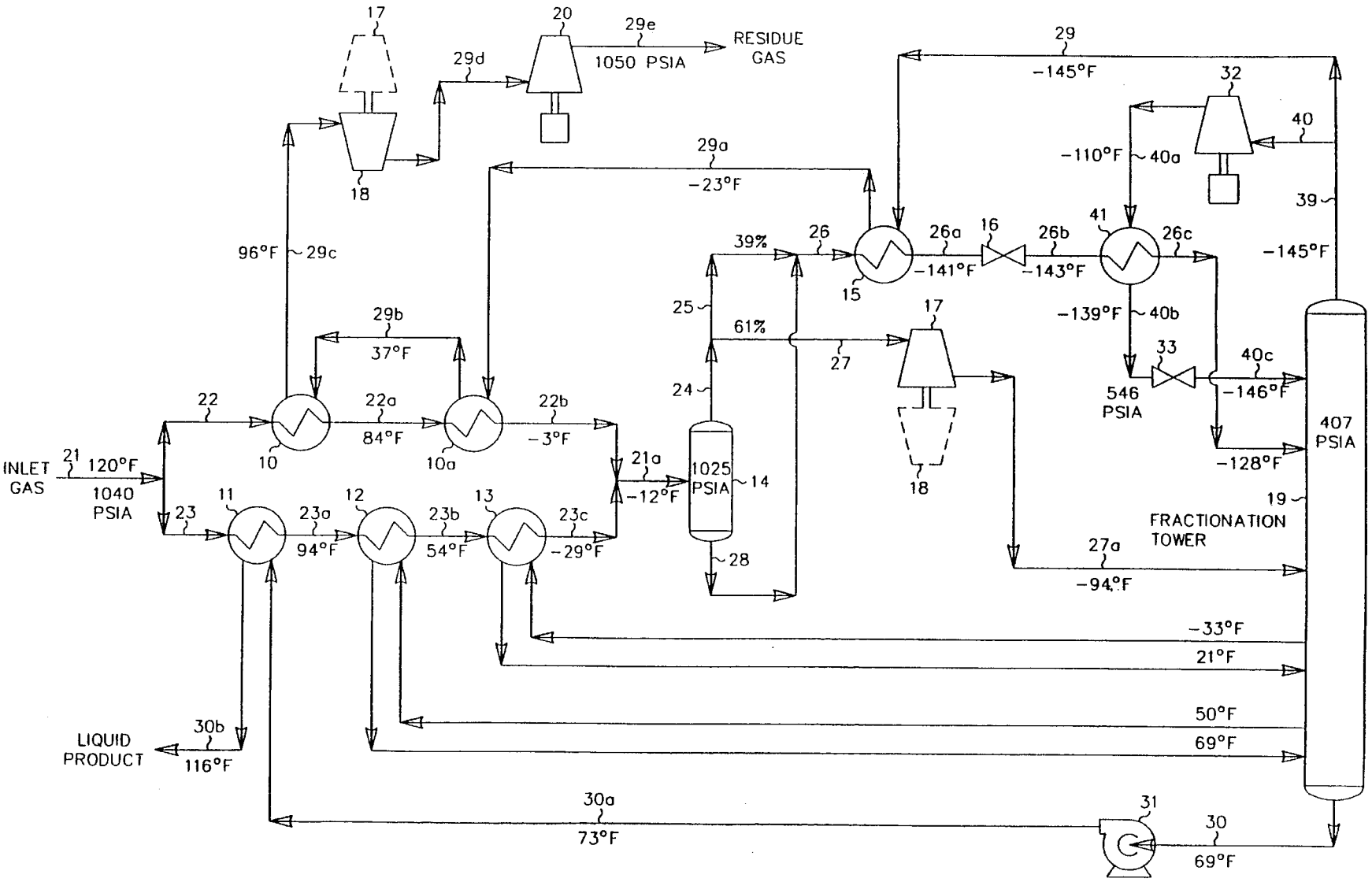
FIG. 3 (PRIOR ART)

Another means of creating a leaner reflux stream for the demethanizer is described in applicants' U.S. Pat. No. 4,889,545. FIG. 3 illustrates a flow diagram in accordance with this prior art process that recycles a portion of the cold residue gas product to provide the leaner top feed to the demethanizer. The process of FIG. 3 has been applied to the same feed gas composition and conditions as described above for FIGS. 1 and 2. In the simulation of this process, as in the simulation for the process of FIGS. 1 and 2, operating conditions were selected to minimize energy consumption for a given recovery level.

In the simulation of FIG. 3, feed stream 21 at 120° F. and 1040 psia is divided into two parallel streams, 22 and 23. The upper stream, 22, is cooled to −3° F. (stream 22*b*) by heat exchange with a portion of the cool residue gas at −23° F. (stream 29*a*) in exchangers 10 and 10*a*.

The lower stream, 23, is cooled to 94° F. (stream 23*a*) by heat exchange with bottom liquid product at 73° F. (stream 30*a*) from the demethanizer bottoms pump, 31, in exchanger 11. The cooled stream, 23*a*, is further cooled to 54° F. (stream 23*b*) by demethanizer liquid at 50° F. in demethanizer reboiler 12, and to −29° F. (stream 23*c*) by demethanizer liquid at −33° F. in demethanizer side reboiler 13.

Following cooling, the two streams, 22*b* and 23*c*, recombine as stream 21*a*. The recombined stream then enters separator 14 at −12° F. and 1025 psia where the vapor (stream 24) is separated from the condensed liquid (stream 28).

The vapor from separator 14 (stream 24) is divided into two portions, streams 25 and 27. Stream 25, consisting of about 39 percent of the total vapor, is combined with the separator liquid stream (stream 28). The combined stream 26 then passes through heat exchanger 15 in heat exchange relation with the −145° F. cold residue gas stream 29 resulting in cooling and substantial condensation of the combined stream. The substantially condensed stream 26*a* at −141° F. is then expanded through an appropriate expansion device, such as expansion valve 16, to a pressure of approximately 407 psia. During expansion, the stream is cooled to −143° F. (stream 26*b*).

The expanded stream 26*b* flows to heat exchanger 41 wherein it is warmed to −128° F. (stream 26*c*) and partially vaporized as it provides cooling and substantial condensation of a compressed recycle portion (stream 40*a*) of distillation stream 39 leaving the top of the demethanizer. The warmed stream 26*c* then enters the demethanizer at a mid-column feed position.

The substantially condensed compressed recycle stream 40*b* leaving exchanger 41 is then expanded through an appropriate expansion device, such as expansion valve 33, to the operating pressure of the demethanizer. During expansion a portion of the stream is vaporized, resulting in cooling of the total stream. In the process illustrated in FIG. 3, the expanded stream 40*c* reaches a temperature of −146° F. and is supplied to the demethanizer as the top column feed (reflux). The vapor portion of stream 40*c* combines with the vapors rising from the top fractionation stage of the column to form distillation stream 39, which is withdrawn from an upper region of the tower. This stream is then divided into two streams. One portion, stream 29, is the cold volatile residue gas. The other portion, recycle stream 40, is compressed to a pressure of about 550 psia in cold recycle compressor 32. The compressed recycle stream 40*a*, now at about −110° F., then flows to heat exchanger 41 where it is cooled and substantially condensed by heat exchange with stream 26*b* as discussed previously.

Returning to the second portion of the vapor from separator 14, stream 27, the remaining 61 percent of the vapor enters a work expansion machine 17 in which mechanical energy is extracted from this portion of the high pressure feed. The machine 17 expands the vapor substantially isentropically from a pressure of about 1025 psia to the operating pressure of the demethanizer, about 401 psia, with the work expansion cooling the expanded stream to a temperature of approximately −94° F. The expanded and partially condensed stream 27*a* is supplied as feed to the distillation column at an intermediate point.

The liquid product stream 30 exits the bottom of tower 19 at 69° F. and is pumped to approximately 655 psia, stream 30*a*, in pump 31. Stream 30*a*, now at about 73° F., is warmed to 116° F. (stream 30*b*) in exchanger 11 as it provides cooling to a portion of the inlet gas, stream 23.

The cold residue gas (stream 29) at a temperature of −145° F. passes countercurrently to stream 26 in heat exchanger 15 where it is warmed to −23° F. (stream 29*a*). The warmed residue gas then passes countercurrently to the incoming feed gas in heat exchanger 10*a* where it is heated to 37° F. (stream 29*b*) and in heat exchanger 10 where it is heated to 96° F. (stream 29*c*). The residue gas is then re-compressed in two stages. The first stage is compressor 18 driven by expansion machine 17. The second stage is compressor 20 driven by a supplemental power source which compresses the residue gas to 1050 psia (stream 29*e*).

A summary of stream flow rates and energy consumption for the process illustrated in FIG. 3 is set forth in the following table:

TABLE III (FIG. 3)
Stream Flow Summary - (Lb. Moles/Hr)

| Stream | Methane | Ethane | Propane | Butanes+ | Total |
|---|---|---|---|---|---|
| 21 | 25382 | 1161 | 362 | 332 | 27448 |
| 24 | 25249 | 1134 | 338 | 224 | 27155 |
| 28 | 133 | 27 | 24 | 108 | 293 |
| 25 | 9822 | 441 | 131 | 87 | 10563 |
| 27 | 15427 | 693 | 207 | 137 | 16592 |
| 39 | 35154 | 13 | 0 | 0 | 35334 |
| 40 | 9800 | 4 | 0 | 0 | 9850 |
| 29 | 25354 | 9 | 0 | 0 | 25484 |
| 30 | 28 | 1152 | 362 | 332 | 1964 |
| | Recoveries* | | | | |
| | Ethane | | | 99.16% | |
| | Propane | | | 100.00% | |
| | Butanes+ | | | 100.00% | |
| | Horsepower | | | | |
| | Residue Compression | | | 13,850 | |

*(Based on un-rounded flow rates)

Comparison of the recovery levels displayed in Table III with those shown in Tables I and II indicates the FIG. 3 process improves the recovery efficiency. In fact, the FIG. 3 process is almost 9% more efficient in terms of ethane recovered per unit of horsepower expended than the FIG. 1 process and 18% more than the FIG. 2 process. However, this process does require the addition of a separate cryogenic gas compressor and a relatively large heat exchanger for condensation of the recycle stream. In addition, it has been found that for richer inlet gas streams the heat (energy) of compression introduced by cold recycle compressor 32 can reduce or negate the benefit obtained by having the leaner top feed (reflux) stream.

DESCRIPTION OF THE INVENTION

EXAMPLE 1

Figure 4:
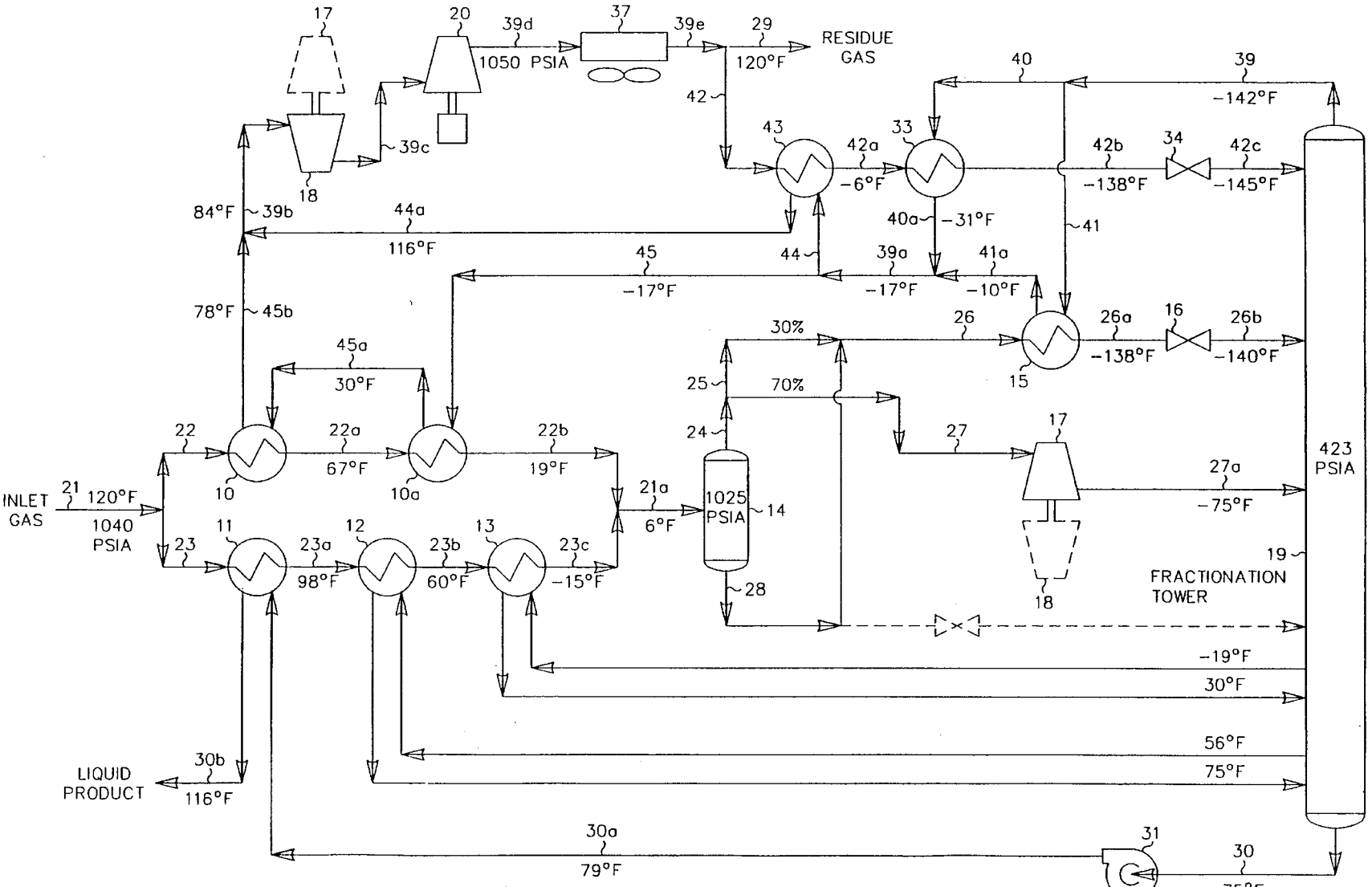
FIG. 4 is a flow diagram of a natural gas processing plant in accordance with the present invention.

FIG. 4 illustrates a flow diagram of a process in accordance with the present invention. The feed gas composition and conditions considered in the process presented in FIG. 4 are the same as those in FIGS. 1 through 3. Accordingly, the FIG. 4 process can be compared with the FIGS. 1 through 3 processes to illustrate the advantages of the present invention.

In the simulation of the FIG. 4 process, inlet gas enters at 120° F. and a pressure of 1040 psia as stream The feed stream is divided into two parallel streams, 22 and 23. The upper stream, 22, is cooled to 19° F. by heat exchange with a portion of the cool residue gas (stream 45) at −17° F. in exchangers 10 and 10*a*.

The lower stream, 23, is cooled to 98° F. (stream 23*a*) by heat exchange with liquid product at 79° F. (stream 30*a*) from the demethanizer bottoms pump, 31, in exchanger 11. The cooled stream, 23*a*, is further cooled to 60° F. (stream 23*b*) by demethanizer liquid at 56° F. in demethanizer reboiler 12, and to −15° F. (stream 23*c*) by demethanizer liquid at −19° F. in demethanizer side reboiler 13.

Following cooling, the two streams, 22*b* and 23*c*, recombine as stream 21*a*. The recombined stream then enters separator 14 at 6° F. and 1025 psia where the vapor (stream 24) is separated from the condensed liquid (stream 28).

The vapor (stream 24) from separator 14 is divided into gaseous first and second streams, 25 and 27. Stream 25, containing about 30 percent of the total vapor, is combined with the separator liquid (stream 28). The combined stream 26 then passes through heat exchanger 15 in heat exchange relation with a portion (stream 41) of the −142° F. cold distillation stream 39, resulting in cooling and substantial condensation of the combined stream. The substantially condensed combined stream 26*a* at −138° F. is then expanded through an appropriate expansion device, such as expansion valve 16, to the operating pressure (approximately 423 psia) of the fractionation tower 19. During expansion, the stream is cooled to −140° F. (stream 26*b*). The expanded stream 26*b* then enters the distillation column or demethanizer at a mid-column feed position. The distillation column is in a lower region of fractionation tower 19.

Returning to the gaseous second stream 27, the remaining 70 percent of the vapor from separator 14 enters an expansion device such as work expansion machine 17 in which mechanical energy is extracted from this portion of the high pressure feed. The machine 17 expands the vapor substantially isentropically from a pressure of about 1025 psia to the pressure of the demethanizer (about 423 psia), with the work expansion cooling the expanded stream to a temperature of approximately −75° F. (stream 27*a*). The expanded and partially condensed stream 27*a* is supplied as feed to the distillation column at a second mid-column feed point.

In the simulation of the process of FIG. 4, the recompressed and cooled distillation stream 39*e* is divided into two streams. One portion, stream 29, is the volatile residue gas product. The other portion, recycle stream 42, flows to heat exchanger 43 where it is cooled to −6° F. (stream 42*a*) by heat exchange with a portion (stream 44) of cool residue gas stream 39*a* at −17° F. The cooled recycle stream then flows to exchanger 33 where it is cooled to −138° F. and substantially condensed by heat exchange with the other portion (stream 40) of cold distillation stream 39 at −142° F. The substantially condensed stream 42*b* is then expanded through an appropriate expansion device, such as expansion valve 34, to the demethanizer operating pressure, resulting in cooling of the total stream. In the process illustrated in FIG. 4, the expanded stream 42*c* leaving expansion valve 34 reaches a temperature of −145° F. and is supplied to the fractionation tower as the top column feed. The vapor portion (if any) of stream 42*c* combines with the vapors rising from the top fractionation stage of the column to form distillation stream 39, which is withdrawn from an upper region of the tower.

The liquid product, stream 30, exits the bottom of tower 19 at 75° F. and is pumped to a pressure of approximately 650 psia in demethanizer bottoms pump 31. The pumped liquid product is then warmed to 116° F. as it provides cooling of stream 23 in exchanger 11.

The cold distillation stream 39 from the upper section of the demethanizer is divided into two portions, streams 40 and 41. Stream 40 passes countercurrently to recycle stream 42*a* in heat exchanger 33 where it is warmed to −31° F. (stream 40*a*) as it provides cooling and substantial condensation of cooled recycle stream 42*a*. Similarly, stream 41 passes countercurrently to stream 26 in heat exchanger 15 where it is warmed to −10° F. (stream 41*a*) as it provides cooling and substantial condensation of stream 26. The two partially warmed streams 40*a* and 41*a* then recombine as stream 39*a*, at a temperature of −17° F. This recombined stream is again divided into two portions, streams 44 and 45. Stream 44 passes countercurrently to recycle stream 42 in exchanger 43 where it is warmed to 116° F. (stream 44*a*). The other portion, stream 45, then flows through heat exchanger 10*a* where it is heated to 30° F. (stream 45*a*) as it provides cooling of stream 22*a* and through heat exchanger 10 where it is heated to 78° F. (stream 45*b*) as it provides cooling of inlet gas stream 22. The two heated streams 44*a* and 45*b* recombine as warm distillation stream 39*b*. The warm distillation stream at 84° F. is then recompressed in two stages. The first stage is compressor 18 driven by expansion machine 17. The second stage is compressor 20 driven by a supplemental power source which compresses the stream to the line pressure of 1050 psia. The compressed stream 39*d* is then cooled to 120° F. by heat exchanger 37, and the cooled stream 39*e* is split into the residue gas product (stream 29) and the recycle stream 42 as described earlier.

A summary of stream flow rates and energy consumption for the process illustrated in FIG. 4 is set forth in the table below:

TABLE IV (FIG. 4)
Stream Flow Summary - (Lb. Moles/Hr)

| Stream | Methane | Ethane | Propane | Butanes+ | Total |
|---|---|---|---|---|---|
| 21 | 25382 | 1161 | 362 | 332 | 27448 |
| 24 | 25311 | 1147 | 349 | 255 | 27272 |
| 28 | 71 | 14 | 13 | 77 | 176 |
| 25 | 7593 | 344 | 105 | 76 | 8182 |
| 27 | 17718 | 803 | 244 | 179 | 19090 |
| 39 | 29954 | 38 | 0 | 0 | 30144 |
| 42 | 4600 | 6 | 0 | 0 | 4630 |
| 29 | 25354 | 32 | 0 | 0 | 25514 |
| 30 | 28 | 1129 | 362 | 332 | 1934 |
| | Recoveries* | | | | |
| | Ethane | | | 97.21% | |
| | Propane | | | 100.00% | |
| | Butanes+ | | | 100.00% | |
| | Horsepower | | | | |
| | Residue Compression | | | 13,850 | |

*(Based on un-rounded flow rates)

Comparison of the recovery levels displayed in Tables I and IV shows that the present invention improves ethane recovery from 91.24% to 97.21%, propane recovery from 98.66% to 100.00%, and butanes+ recovery from 99.81% to 100.00%. Comparison of Tables I and IV further shows that the improvement in yields was not simply the result of increasing the horsepower (utility) requirements. To the contrary, when the present invention is employed as in Example 1, not only do the ethane, propane, and butanes+ recoveries increase over those of the prior art process, but liquid recovery efficiency also increases by 6.5 percent (in terms of ethane recovered per unit of horsepower expended).

Comparing the present invention to the prior art process displayed in FIG. 2, Tables II and IV shows that the FIG. 2 prior art process essentially matches the recovery levels of the present invention for $C_2$+ components. However, unlike the FIG. 2 process, the present invention is able to recycle a portion of the distillation column overhead stream to make a leaner top tower feed without increasing the horsepower requirements above that of the lower recovery FIG. 1 process. The present invention achieves the same recovery levels using only 86 percent of the external power required by the FIG. 2 prior art process.

The higher power consumption of the FIG. 2 prior art process is due to the large recycle stream that is required for high ethane recovery. As shown in Table II, the majority of the $C_2$+ components contained in the inlet feed gas enter the demethanizer in the mostly vapor stream (stream 27*a*) leaving the work expansion machine. As a result, the quantity of the cold recycle stream feeding the upper section of the demethanizer must be large enough to condense these $C_2$+ components so that these components can be recovered in the liquid product leaving the bottom of the fractionation column.

In addition, the process of FIG. 2 requires that the separator 14 operate at a much colder temperature to help reduce the quantity of $C_2$+ components entering the column in the vapor phase of expander 17 outlet stream 27*a*. While this colder separator temperature provides increased condensation in stream 27*a* during expansion, it reduces the net energy (horsepower) generated by the expander, thereby increasing residue compression requirements.

In the present invention, however, the flash expanded stream 26*b* supplied to fractionation tower 19 at a mid-column feed point condenses the majority of the $C_2$+ components in the stream leaving the work expansion machine. This means that the recycle stream supplied to the column as a cold, lean top (reflux) feed need only rectify the vapors rising above the flash expanded stream, condensing and recovering the small amount of $C_2$+ components in the rising vapors. Since the flash expanded stream (stream 26*b*) provides bulk recovery of the $C_2$+ components, a smaller recycle flow is needed (compared to the FIG. 2 prior art process) to maintain high ethane recovery, with the resultant savings in external power requirements.

Comparing the present invention to the prior art process displayed in FIG. 3, Tables III and IV show that the present invention process very nearly matches the recovery efficiency of the FIG. 3 prior art process for $C_2$+ components. However, unlike the FIG. 3 process, the present invention does not require a separate cryogenic compressor to recycle a portion of column overhead stream to make the leaner top tower feed. It is possible to incorporate the recycle compression requirements with those of the residue gas compressor without increasing the overall horsepower (utility) requirements.

EXAMPLE 2

Figure 5:
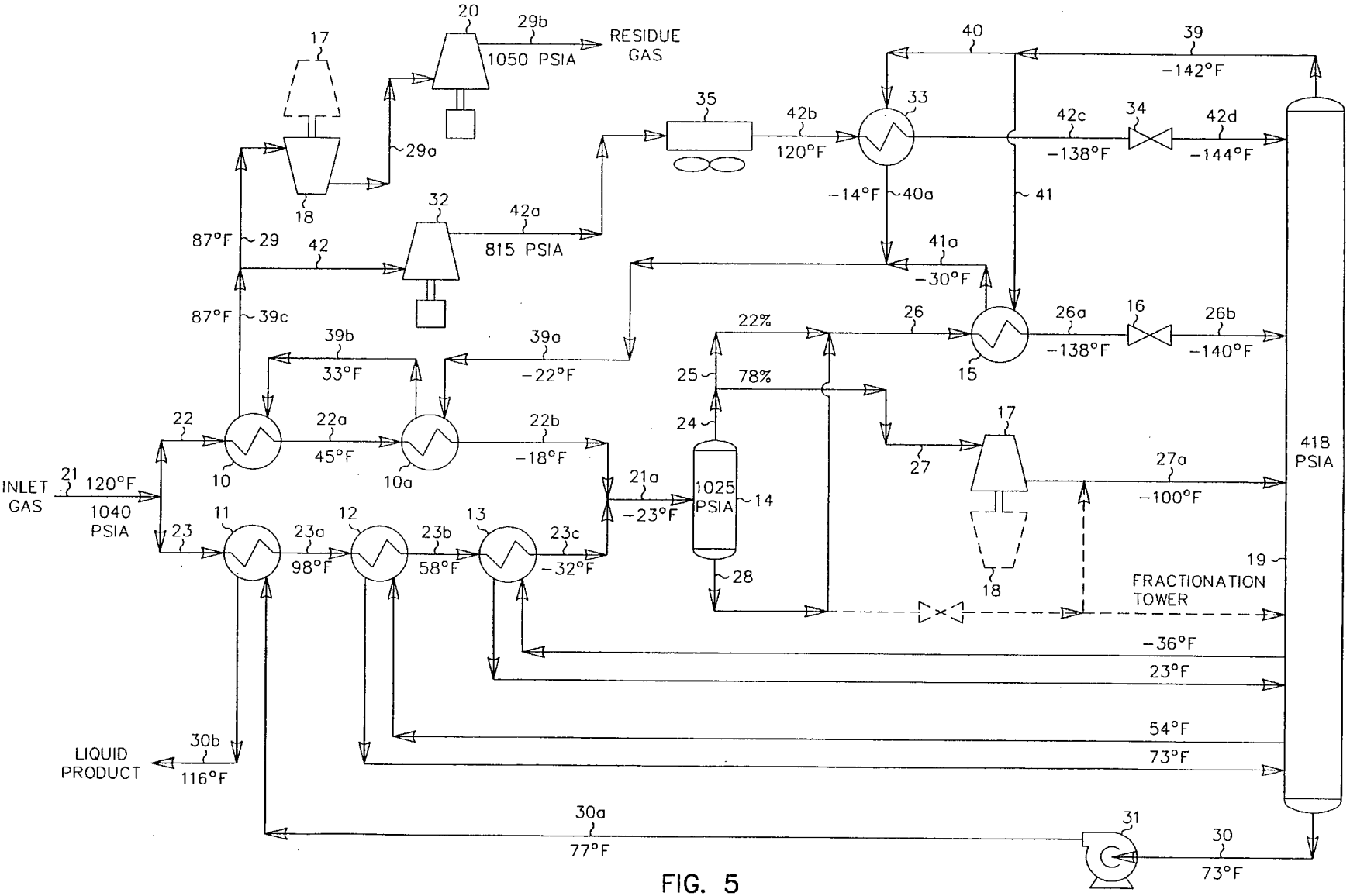
FIGS. 5 and 6 are flow diagrams illustrating alternative means of application of the present invention to a natural gas stream.

FIG. 4 represents the preferred embodiment of the present invention for the temperature and pressure conditions shown because it typically requires the least equipment and the lowest capital investment. Additional improvement of $C_2$ component recovery can be achieved by another embodiment of the present invention through the use of a separate warm recycle compressor for the recycle (reflux) stream, as illustrated in the FIG. 5 process. The feed gas composition and conditions considered in the process presented in FIG. 5 are the same as those in FIGS. 1 through 4. Accordingly, FIG. 5 can be compared with the FIGS. 1 through 3 processes to illustrate the advantages of the present invention, and can likewise be compared to the embodiment displayed in FIG. 4.

In the simulation of the FIG. 5 process, the inlet gas cooling and expansion scheme is essentially the same as that used in FIG. 4. The difference lies in the disposition of the recycle stream 42 to be compressed in the compressor 32. Rather than compressing the entire distillation stream (stream 39*c*) to line pressure in compressors 18 and 20, the recycle stream (stream 42) can be compressed in its own compressor to a lower pressure, reducing the utility requirement per unit of recycle flow. One method of accomplishing this is as shown in FIG. 5, where the warmed distillation stream 39*c* leaving heat exchanger 10 is split into two portions. The first portion, stream 29, is re-compressed in two stages (compressors 18 and 20 arranged in series) to line pressure and becomes the residue gas product, stream 29*b*.

The second portion, recycle stream 42, enters the warm recycle compressor 32 and is compressed to about 815 psia (stream 42*a*). The compressed stream is cooled to 120° F. in heat exchanger 35 (stream 42*b*), then enters heat exchanger 33 where it is cooled and substantially condensed by heat exchange with a portion of the distillation stream leaving the upper region of fractionation tower 19 (stream 40) as discussed previously. The substantially condensed stream 42*c* at −138° F. is then flash expanded in expansion valve 34. The cold, flash expanded stream 42*d*, now at about −144° F., is supplied as the top feed to fractionation tower 19.

A summary of stream flow rates and energy consumptions for the process illustrated in FIG. 5 is set forth in the table below:

TABLE V (FIG. 5)
Stream Flow Summary - (Lb. Moles/Hr)

| Stream | Methane | Ethane | Propane | Butanes+ | Total |
|---|---|---|---|---|---|
| 21 | 25382 | 1161 | 362 | 332 | 27448 |
| 24 | 25187 | 1122 | 328 | 205 | 27050 |
| 28 | 195 | 39 | 34 | 127 | 398 |
| 25 | 5453 | 243 | 71 | 44 | 5856 |
| 27 | 19734 | 879 | 257 | 161 | 21194 |
| 39 | 30587 | 26 | 0 | 0 | 30766 |
| 42 | 5234 | 4 | 0 | 0 | 5265 |
| 29 | 25353 | 22 | 0 | 0 | 25501 |
| 30 | 29 | 1139 | 362 | 332 | 1947 |

| Recoveries* | |
|---|---|
| Ethane | 98.13% |
| Propane | 100.00% |
| Butanes+ | 100.00% |
| Horsepower | |
| Residue Compression | 12,215 |
| Warm Recycle Compression | 1,635 |
| Total Horsepower | 13,850 |

*(Based on un-rounded flow rates)

The use of warm recycle compressor 32 in the FIG. 5 process allows compressing the recycle stream 42 to an optimum pressure for subsequent cooling and substantial condensation by the distillation stream from fractionation tower 19, regardless of the line pressure to which the residue gas product (stream 29*b*) must be compressed. Comparison of the recovery levels displayed in Tables IV and V for the FIG. 4 and FIG. 5 processes shows that utilizing the additional equipment improves the ethane recovery from 97.21% to 98.13% . The propane and butanes+ recoveries remain at 100.00%. These two embodiments of the present invention have essentially the same total horsepower (utility) requirements. The choice of where to withdraw recycle stream 42 in the process will generally depend on factors which include plant size and available equipment. For example, if multiple stage compression or multi-wheel centrifugal compression is used to compress the warmed distillation stream 39*c*, the recycle stream 42 may be withdrawn at an intermediate stage or wheel pressure.

EXAMPLE 3

Figure 6:
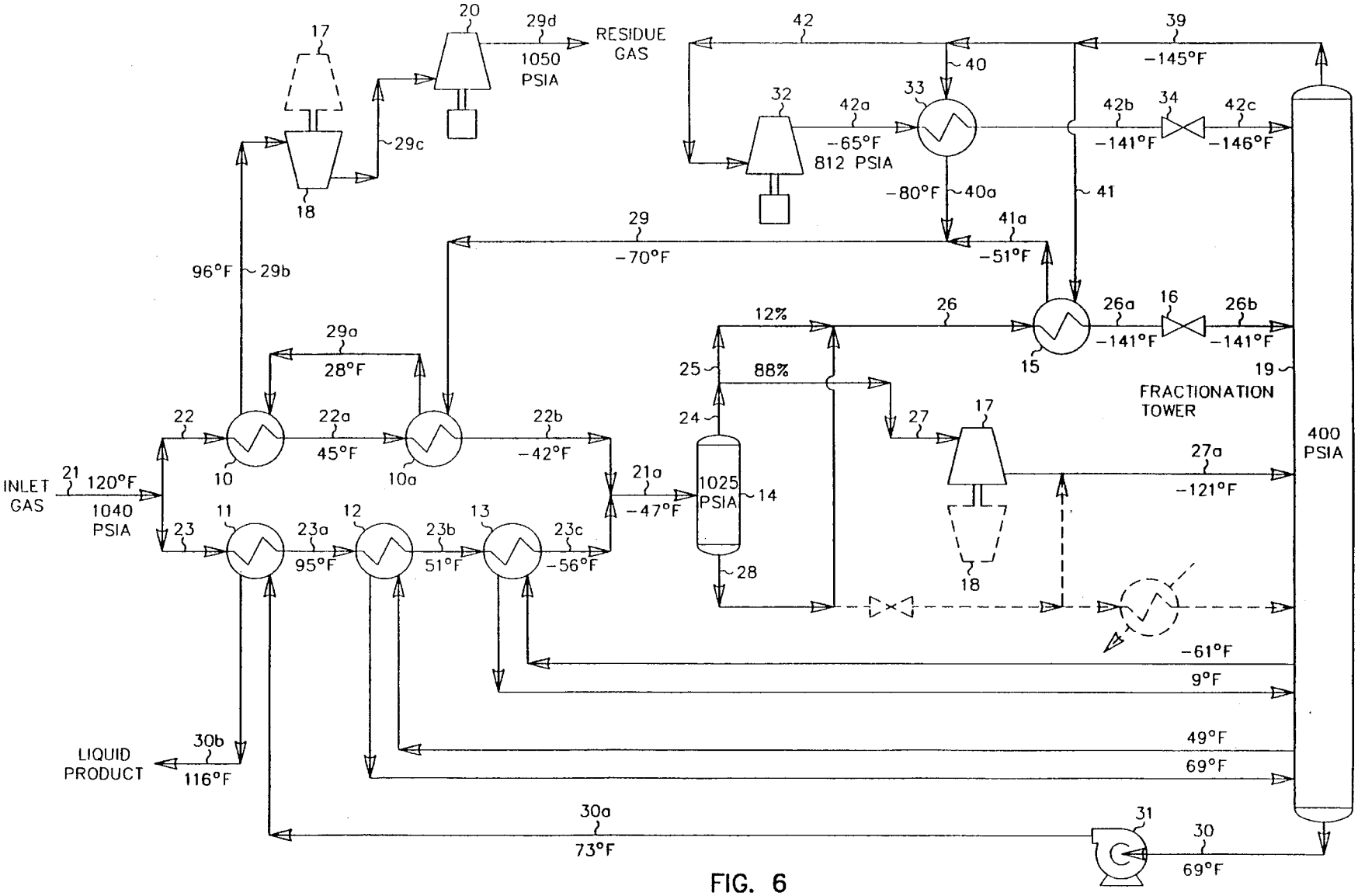

A third embodiment of the present invention is shown in FIG. 6, wherein additional improvement of $C_2$ component recovery can be achieved through the use of a separate cold recycle compressor for the recycle (reflux) stream. The feed gas composition and conditions considered in the process illustrated in FIG. 6 are the same as those in FIGS. 1 through 5.

In the simulation of the process of FIG. 6, the inlet gas cooling and expansion scheme is essentially the same as that used in FIGS. 4 and 5. The difference lies in where the gas stream to be compressed, substantially condensed and used as top tower feed to the demethanizer is withdrawn from the distillation stream 39. Referring to FIG. 6, the cold distillation stream 39 leaving the upper region of fractionation tower 19 is divided into three streams, 40, 41, and 42. Streams 40 and 41 are used to cool and substantially condense the recycle stream (stream 42*a*) and the combined stream (stream 26), respectively, and then recombine as the residue gas fraction (stream 29) which is warmed and re-compressed in two stages as previously discussed.

Stream 42 is the recycle stream which is compressed in cold recycle compressor 32 to about 812 psia. The compressed stream 42*a* is then cooled and substantially condensed in heat exchanger 33 by heat exchange relation with a portion of the cold distillation stream (stream 40). The substantially condensed stream 42*b* at −141° F. is then flash expanded in expansion valve 34 and the expanded stream 42*c* flows as top feed at −146° F. to fractionation tower 19.

A summary of stream flow rates and energy consumptions for the process illustrated in FIG. 6 is set forth in the table below:

TABLE VI (FIG. 6)
Stream Flow Summary - (Lb. Moles/Hr)

| Stream | Methane | Ethane | Propane | Butanes+ | Total |
|---|---|---|---|---|---|
| 21 | 25382 | 1161 | 362 | 332 | 27448 |
| 24 | 24887 | 1073 | 296 | 165 | 26626 |
| 28 | 495 | 88 | 66 | 167 | 822 |
| 25 | 3011 | 130 | 36 | 20 | 3221 |
| 27 | 21876 | 943 | 260 | 145 | 23405 |
| 39 | 30666 | 19 | 0 | 0 | 30830 |
| 42 | 5312 | 3 | 0 | 0 | 5340 |
| 29 | 25354 | 15 | 0 | 0 | 25490 |
| 30 | 28 | 1146 | 362 | 332 | 1958 |

| Recoveries* | |
|---|---|
| Ethane | 98.66% |
| Propane | 100.00% |
| Butanes+ | 100.00% |
| Horsepower | |
| Residue Compression | 12,962 |
| Cold Recycle Compression | 889 |
| Total Horsepower | 13,851 |

*(Based on un-rounded flow rates)

The use of cold recycle compressor 32 in the FIG. 6 process allows more efficient compression of the recycle stream 42 to the optimum pressure for subsequent cooling and substantial condensation by the distillation stream from fractionation tower 19, regardless of the line pressure to which the residue gas product (stream 29*b*) must be compressed. Comparison of the recovery levels displayed in Tables V and VI for the FIG. 5 and FIG. 6 processes shows that utilizing the cold recycle compressor improves the ethane recovery from 98.13% to 98.66%. The propane and butanes+ recoveries remain at 100.00%. These two embodiments of the present invention have essentially the same total horsepower (utility) requirements. The choice between compressing recycle stream 42 cold or warm will generally depend on factors such as feed composition, plant size and available equipment.

Other Embodiments

The high pressure liquid stream 28 in FIGS. 4 through 6 need not be combined with the portion of the separator vapor (stream 25) flowing to heat exchanger 15. Alternatively, stream 28 (or a portion thereof) may be expanded through an appropriate expansion device, such as an expansion valve or expansion machine, and fed to a third mid-column feed point on the distillation column. (This is shown by the dashed line in FIG. 4.) Stream 28 may also be used for inlet gas cooling or other heat exchange service before or after the expansion step prior to flowing to the demethanizer.

Figure 7:
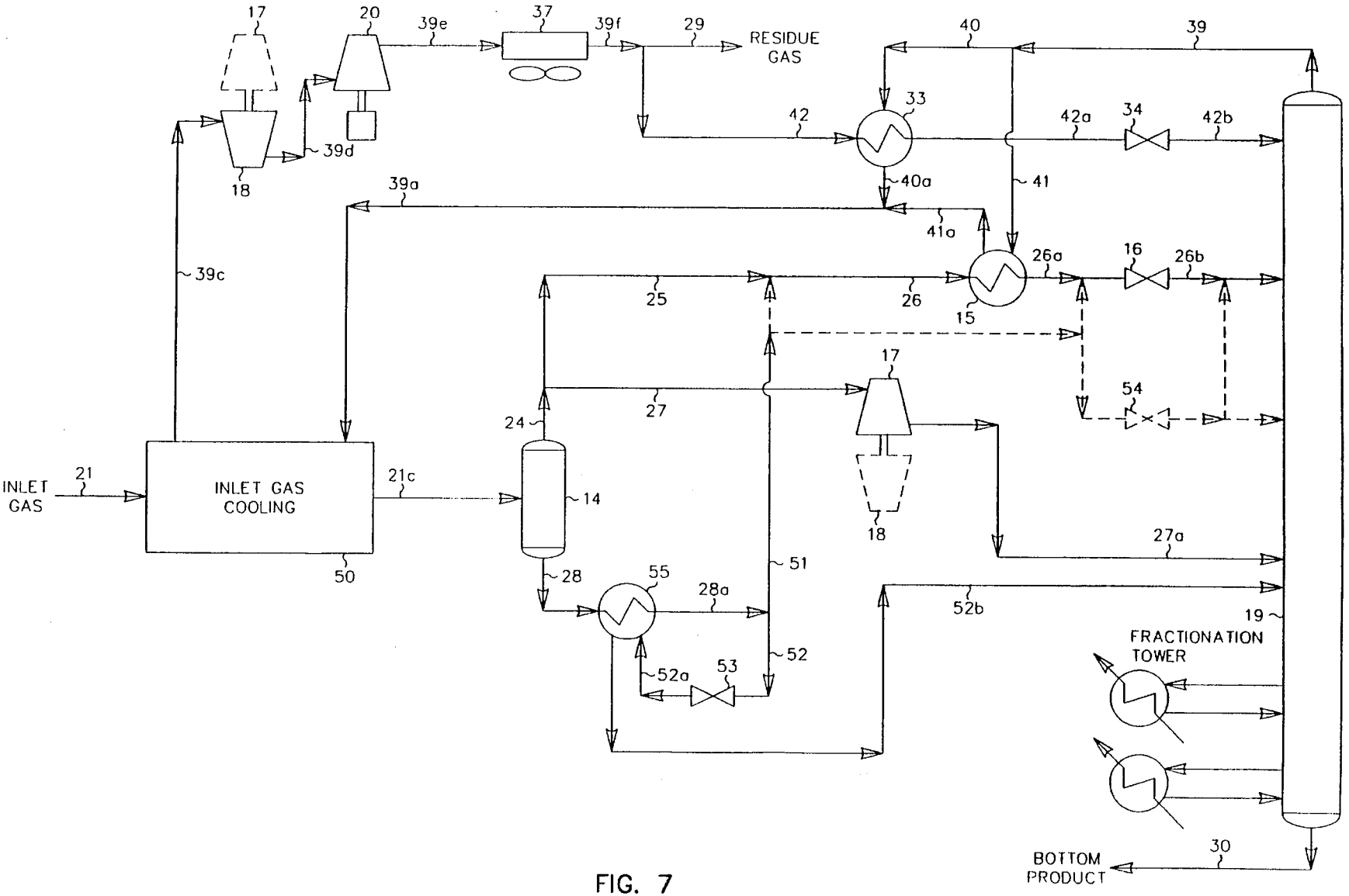
FIG. 7 is a fragmentary flow diagram showing a natural gas processing plant in accordance with the present invention for a richer gas stream.

In instances where the inlet gas is richer than that heretofore described, an embodiment such as that depicted in FIG. 7 may be employed. Condensed stream 28 flows through heat exchanger 55 where it is subcooled by heat exchange with the cooled stream 52*a* from expansion valve 53. The subcooled liquid (stream 28*a*) is then divided into two portions. The first portion (stream 52) flows through expansion valve 53 where it undergoes expansion and flash vaporization as the pressure is reduced to about the pressure of the fractionation tower. The cold stream 52*a* from expansion valve 53 then flows through heat exchanger 55, where it is used to subcool the liquids from separator 14. From exchanger 55 the stream 52*b* flows to the distillation column in fractionation tower 19 as a lower mid-column feed. The second liquid portion, stream 51, still at high pressure, is either: (1) combined with portion 25 of the vapor stream from separator 14, (2) combined with substantially condensed stream 26*a* , or (3) expanded in expansion valve 54 and thereafter either supplied to the distillation column at an upper mid-column feed position or combined with expanded stream 26*b*. Alternatively, portions of stream 51 may follow more than one and indeed all of the flow paths heretofore described and depicted in FIG. 7.

The process of the present invention is also applicable for processing gas streams when it is desirable to recover only the $C_3$ components and heavier hydrocarbon components (rejection of $C_2$ components and lighter components to the residue gas). Such an embodiment of the present invention may take the form of that shown in FIG. 8. Because of the warmer process operating conditions associated with propane recovery (ethane rejection) operation, the inlet gas cooling scheme is usually different than for the ethane recovery cases illustrated in FIGS. 4 through 7.

Figure 8:
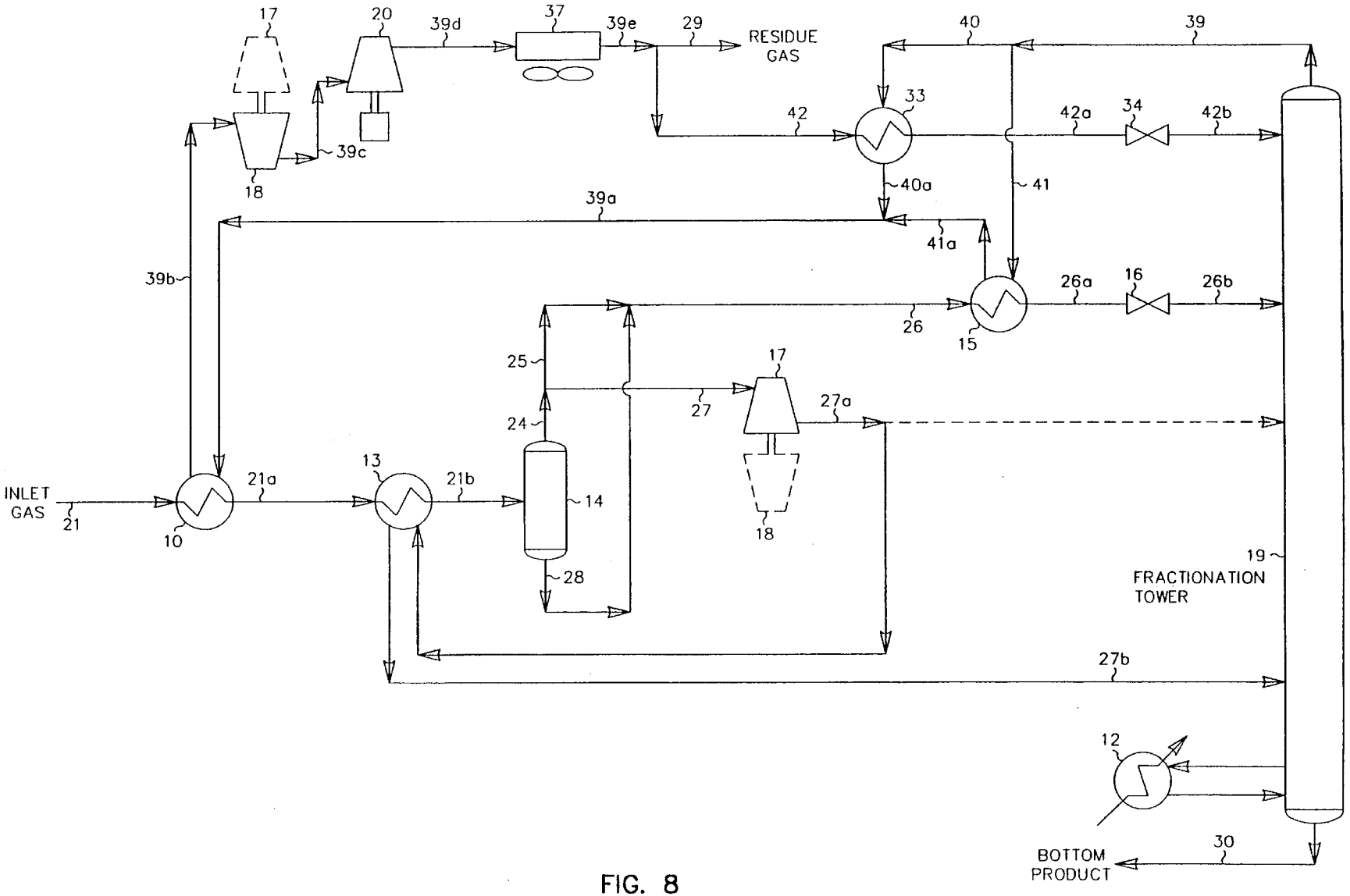
FIG. 8 is a fragmentary flow diagram illustrating an alternative means of application of the present invention to a natural gas stream from which recovery of propane and heavier hydrocarbons is desired.

Referring to FIG. 8, inlet gas enters the process as stream 21 and is cooled by heat exchange with cool distillation stream 39*a* in exchanger 10 (stream 21a) and by the expander outlet stream 27*a* in heat exchanger 13 (stream 21*b*). The feed stream 21*b* then enters separator 14 at pressure where the vapor (stream 24) is separated from the condensed liquid (stream 28).

The vapor (stream 24) from separator 14 is divided into gaseous first and second streams, 25 and 27. Stream 25 may be combined with the separator liquid (stream 28) and the combined stream 26 then passes through heat exchanger 15 in heat exchange relation with cold distillation stream fraction 41, resulting in cooling and substantial condensation of the combined stream. The substantially condensed stream 26*a* is then expanded through an appropriate expansion device, such as expansion valve 16, to the operating pressure of fractionation tower 19. During expansion, a portion of the stream may vaporize, resulting in cooling of the total stream (stream 26*b*) before it is supplied to the deethanizer distillation column in fractionation tower 19 at a mid-column feed position.

Returning to the gaseous second stream 27, the remainder of the vapor from separator 14 enters an expansion device such as work expansion machine 17 as described in earlier examples. The expansion machine 17 expands the vapor substantially isentropically from feed gas pressure to somewhat above the operating pressure of the deethanizer, thereby cooling the expanded stream. The expanded and partially condensed stream 27*a* then (a) flows to a mid-column feed position, (b) flows to exchanger 13 where it is warmed as it provides cooling of the inlet gas stream before being supplied to the deethanizer at a second mid-column feed position, or (c) a combination of (a) and (b) above.

The recompressed and cooled distillation stream 39*e* is divided into two streams. One portion, stream 29, is the residue gas product. The other portion, recycle stream 42, flows to heat exchanger 33 where it is cooled and substantially condensed by heat exchange with a portion (stream 40) of cold distillation stream 39. The substantially condensed stream 42*a* is then expanded through an appropriate expansion device, such as expansion valve 34, to the deethanizer operating pressure, resulting in cooling of the total stream. The expanded stream 42*b* leaving expansion valve 34 is supplied to the fractionation tower 19 as the top column feed. The vapor portion (if any) of stream 42*b* combines with the vapors rising from the top fractionation stage of the column to form distillation stream 39, which is withdrawn from an upper region of the tower.

The deethanizer includes a reboiler 12 which heats and vaporizes a portion of the liquids flowing down the column to provide the stripping vapors which flow up the column. When operating as a deethanizer (ethane rejection), the tower reboiler temperatures are significantly warmer than when operating as a demethanizer (ethane recovery). Generally this makes it impossible to reboil the tower using plant inlet feed as is typically done for ethane recovery operation. Therefore, an external source for reboil heat is normally employed. In some cases a portion of compressed residue gas stream 39*d* can be used to provide the necessary reboil heat.

The liquid product stream 30 exits the bottom of tower 19. A typical specification for this stream is an ethane to propane ratio of 0.025:1 on a molar basis. The cold distillation stream 39 from the upper section of the demethanizer is divided into two streams, 40 and 41. Stream 40 passes countercurrently to stream 42 in heat exchanger 33 where it is heated (stream 40*a*) as it provides cooling and substantial condensation of stream 42. Similarly, stream 41 passes countercurrently to stream 26 in heat exchanger 15 where it is heated (stream 41*a*) as it provides cooling and substantial condensation of stream 26. The two partially warmed streams 40*a* and 41*a* recombine as stream 39*a*, which then flows to heat exchanger 10 where it is heated (stream 39*b*) as it provides cooling of inlet gas stream 21. The distillation stream is then re-compressed in two stages by compressor 18, driven by expansion machine 17, and compressor 20, driven by a supplemental power source. The compressed stream 39*d* is then cooled by heat exchanger 37, and the cooled stream 39*e* is split into the residue gas product (stream 29) and the recycle stream 42 as described earlier.

Figure 9:
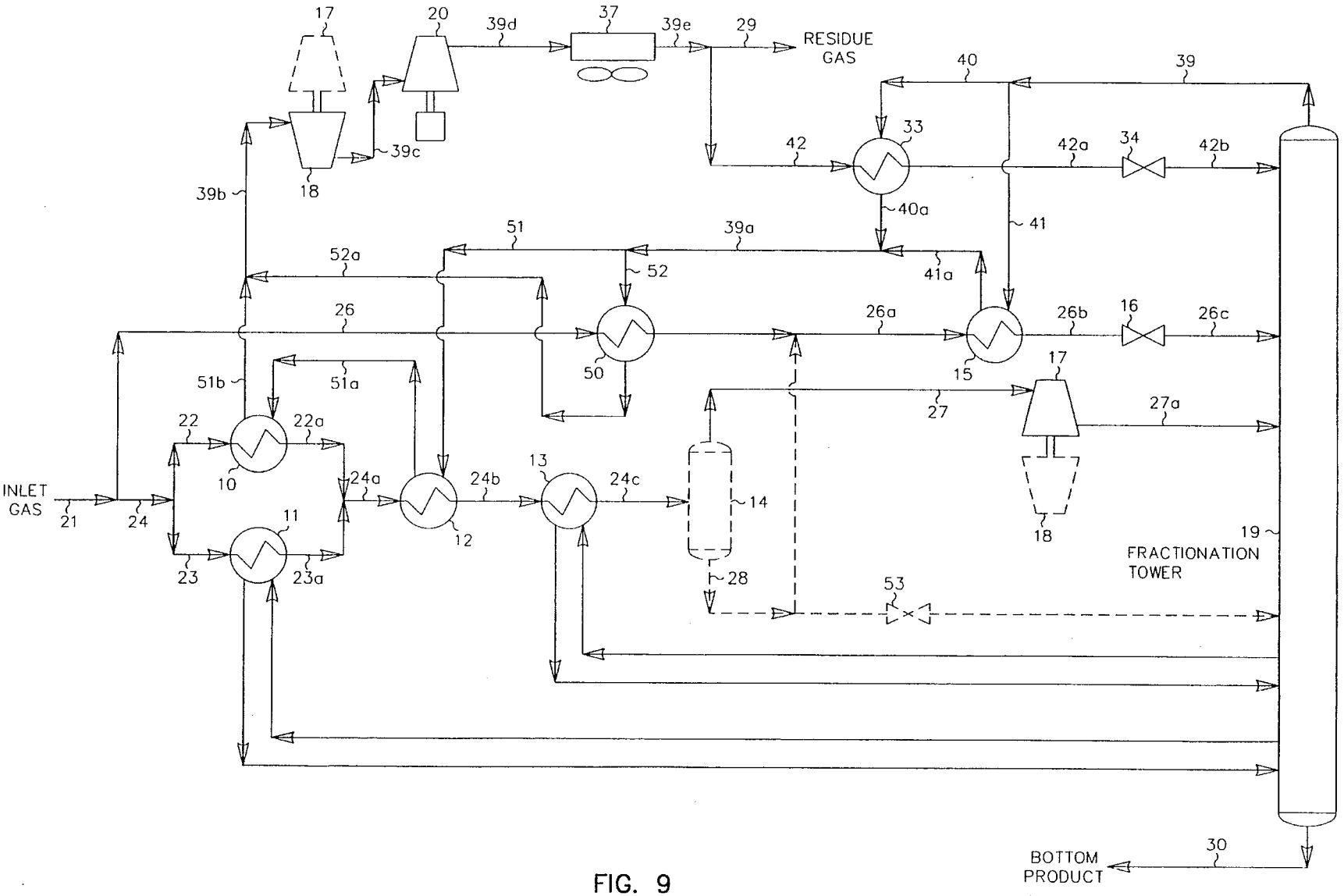
FIGS. 9 and 10 are fragmentary flow diagrams illustrating alternative means of application of the present invention to a natural gas stream.
Figure 10:
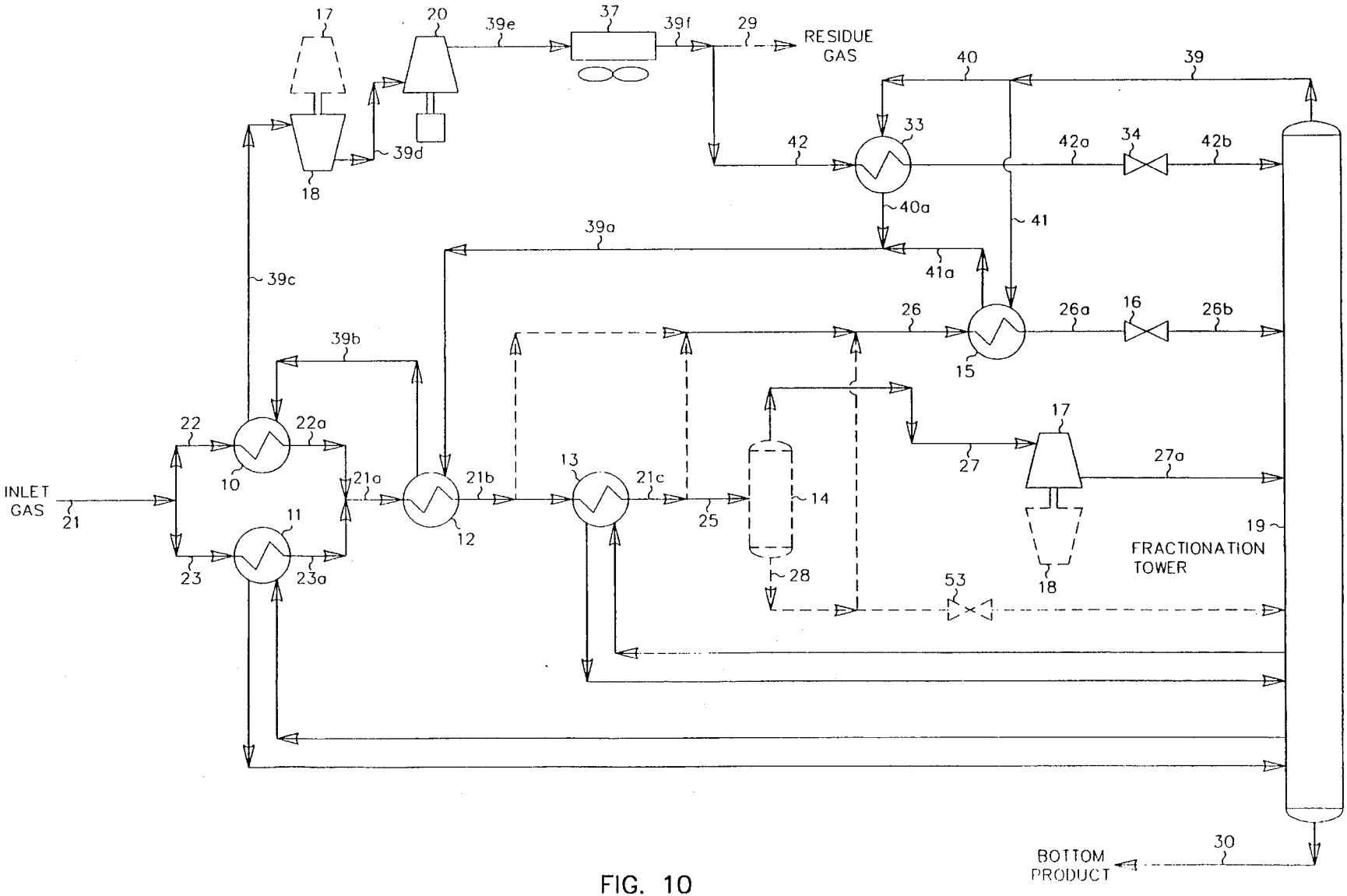

In accordance with this invention, the splitting of the vapor feed may be accomplished in several ways. In the processes of FIGS. 4 through 8, the splitting of vapor occurs following cooling and separation of any liquids which may have been formed. The high pressure gas may be split, however, prior to any cooling of the inlet gas as shown in FIG. 9 or after the cooling of the gas and prior to any separation stages as shown in FIG. 10. In some embodiments, vapor splitting may be effected in a separator. Alternatively, the separator 14 in the processes shown in FIGS. 9 and 10 may be unnecessary if the inlet gas is relatively lean. Moreover, the use of external refrigeration to supplement the cooling available to the inlet gas from other process streams may be employed, particularly in the case of an inlet gas richer than that used in Example 1. The use and distribution of demethanizer liquids for process heat exchange, and the particular arrangement of heat exchangers for inlet gas cooling must be evaluated for each particular application, as well as the choice of process streams for specific heat exchange services. For example, the second stream depicted in FIG. 10, stream 25, may be cooled after division of the inlet stream and prior to expansion of the second stream.

It will also be recognized that the relative amount of feed found in each branch of the split vapor feed will depend on several factors, including gas pressure, feed gas composition, the amount of heat which can economically be extracted from the feed and the quantity of horsepower available. More feed to the top of the column may increase recovery while decreasing power recovered from the expander thereby increasing the recompression horsepower requirements. Increasing feed lower in the column reduces the horsepower consumption but may also reduce product recovery. The mid-column feed positions depicted in FIGS. 4 through 6 are the preferred feed locations for the process operating conditions described. However, the relative locations of the mid-column feeds may vary depending on inlet composition or other factors such as desired recovery levels and amount of liquid formed during inlet gas cooling. Moreover, two or more of the feed streams, or portions thereof, may be combined depending on the relative temperatures and quantities of individual streams, and the combined stream then fed to a mid-column feed position. FIGS. 4 through 6 are the preferred embodiments for the compositions and pressure conditions shown. Although individual stream expansion is depicted in particular expansion devices, alternative expansion means may be employed where appropriate. For example, conditions may warrant work expansion of the substantially condensed portion of the feed stream (26*a* in FIG. 4) or the substantially condensed recycle stream (42*b* in FIG. 4).

The embodiments shown in FIGS. 4 through 7, 9 and 10 can also be used when it is desirable to recover only the $C_3$ components and heavier components ($C_2$ component rejection). This is accomplished by appropriate adjustment of the column feed rates and conditions.

While there have been described what are believed to be preferred embodiments of the invention, those skilled in the art will recognize that other and further modifications may be made thereto, e.g. to adapt the invention to various conditions, types of feed or other requirements without departing from the spirit of the present invention as defined by the following claims.

We claim:

1. In a process for the separation of a gas stream containing methane, $C_2$ components, $C_3$ components and heavier hydrocarbon components into a volatile residue gas fraction containing a major portion of said methane and a relatively less volatile fraction containing a major portion of said $C_2$ components, $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_2$ components, $C_3$ components and heavier components is recovered in said relatively less volatile fraction;

the improvement wherein said gas stream is cooled sufficiently to partially condense it; and (1) said partially condensed gas stream is separated thereby to provide a vapor stream and a condensed stream;

(2) said vapor stream is thereafter divided into gaseous first and second streams;

(3) said gaseous first stream is combined with at least a portion of said condensed stream to form a combined stream and said combined stream is cooled to condense substantially all of it and is thereafter expanded to said lower pressure whereby it is further cooled;

(4) said expanded cooled combined stream is thereafter supplied at a first mid-column feed position to a distillation column in a lower region of a fractionation tower;

(5) said gaseous second stream is expanded to said lower pressure and is supplied to said distillation column at a second mid-column feed position;

(6) a distillation stream is withdrawn from an upper region of said tower and is warmed;

(7) said warmed distillation stream is compressed to higher pressure and thereafter divided into said volatile residue gas fraction and a compressed recycle stream;

(8) said compressed recycle stream is cooled sufficiently to substantially condense it;

(9) said substantially condensed compressed recycle stream is expanded to said lower pressure and supplied to said fractionation tower at a top feed position; and

(10) the quantity and pressure of said compressed recycle stream and the quantities and temperatures of said feed streams to the column are effective to maintain tower overhead temperature at a temperature whereby the major portion of said $C_2$ components, $C_3$ components and heavier hydrocarbon components is recovered in said relatively less volatile fraction.

2. In a process for the separation of a gas stream containing methane, $C_2$ components, $C_3$ components and heavier hydrocarbon components into a volatile residue gas fraction containing a major portion of said methane and said $C_2$ components and a relatively less volatile fraction containing a major portion of said $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_3$ components and heavier components is recovered in said relatively less volatile fraction;

the improvement wherein said gas stream is cooled sufficiently to partially condense it; and (1) said partially condensed gas stream is separated thereby to provide a vapor stream and a condensed stream;

(2) said vapor stream is thereafter divided into gaseous first and second streams;

(3) said gaseous first stream is combined with at least a portion of said condensed stream to form a combined stream and said combined stream is cooled to condense substantially all of it and is thereafter expanded to said lower pressure whereby it is further cooled;

(4) said expanded cooled combined stream is thereafter supplied at a first mid-column feed position to a distillation column in a lower region of a fractionation tower;

(5) said gaseous second stream is expanded to said lower pressure and is supplied to said distillation column at a second mid-column feed position;

(6) a distillation stream is withdrawn from an upper region of said tower and is warmed;

(7) said warmed distillation stream is compressed to higher pressure and thereafter divided into said volatile residue gas fraction and a compressed recycle stream;

(8) said compressed recycle stream is cooled sufficiently to substantially condense it;

(9) said substantially condensed compressed recycle stream is expanded to said lower pressure and supplied to said fractionation tower at a top feed position; and

(10) the quantity and pressure of said compressed recycle stream and the quantities and temperatures of said feed streams to the column are effective to maintain tower overhead temperature at a temperature whereby the major portion of said $C_3$ components and heavier hydrocarbon components is recovered in said relatively less volatile fraction.

3. In a process for the separation of a gas stream containing methane, $C_2$ components, $C_3$ components and heavier hydrocarbon components into a volatile residue gas fraction containing a major portion of said methane and a relatively less volatile fraction containing a major portion of said $C_2$ components, $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_2$ components, $C_3$ components and heavier components is recovered in said relatively less volatile fraction;

the improvement wherein prior to cooling, said gas is divided into gaseous first and second streams; and (1) said gaseous second stream is cooled under pressure sufficiently to partially condense it;

(2) said partially condensed second stream is separated thereby to provide a vapor stream and a condensed stream;

(3) said gaseous first stream is cooled and then combined with at least a portion of said condensed stream to form a combined stream and said combined stream is cooled to condense substantially all of it and is thereafter expanded to said lower pressure whereby it is further cooled;

(4) said expanded cooled combined stream is thereafter supplied at a first mid-column feed position to a distillation column in a lower region of a fractionation tower;

(5) said vapor stream is expanded to said lower pressure and is supplied to said distillation column at a second mid-column feed position;

(6) a distillation stream is withdrawn from an upper region of said tower and is warmed;

(7) said warmed distillation stream is compressed to higher pressure and thereafter divided into said volatile residue gas fraction and a compressed recycle stream;

(8) said compressed recycle stream is cooled sufficiently to substantially condense it;

(9) said substantially condensed compressed recycle stream is expanded to said lower pressure and supplied to said fractionation tower at a top feed position; and

(10) the quantity and pressure of said compressed recycle stream and the quantities and temperatures of said feed streams to the column are effective to maintain tower overhead temperature at a temperature whereby the major portion of said $C_2$ components, $C_3$ components and heavier hydrocarbon components is recovered in said relatively less volatile fraction.

4. In a process for the separation of a gas stream containing methane, $C_2$ components, $C_3$ components and heavier hydrocarbon components into a volatile residue gas fraction containing a major portion of said methane and said $C_2$ components and a relatively less volatile fraction containing a major portion of said $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_3$ components and heavier components is recovered in said relatively less volatile fraction;

the improvement wherein prior to cooling, said gas is divided into gaseous first and second streams; and (1) said gaseous second stream is cooled under pressure sufficiently to partially condense it;

(2) said partially condensed second stream is separated thereby to provide a vapor stream and a condensed stream;

(3) said gaseous first stream is cooled and then combined with at least a portion of said condensed stream to form a combined stream and said combined stream is cooled to condense substantially all of it and is thereafter expanded to said lower pressure whereby it is further cooled;

(4) said expanded cooled combined stream is thereafter supplied at a first mid-column feed position to a distillation column in a lower region of a fractionation tower;

(5) said vapor stream is expanded to said lower pressure and is supplied to said distillation column at a second mid-column feed position;

(6) a distillation stream is withdrawn from an upper region of said tower and is warmed;

(7) said warmed distillation stream is compressed to higher pressure and thereafter divided into said volatile residue gas fraction and a compressed recycle stream;

(8) said compressed recycle stream is cooled sufficiently to substantially condense it;

(9) said substantially condensed compressed recycle stream is expanded to said lower pressure and supplied to said fractionation tower at a top feed position; and

(10) the quantity and pressure of said compressed recycle stream and the quantities and temperatures of said feed streams to the column are effective to maintain tower overhead temperature at a temperature whereby the major portion of said $C_3$ components and heavier hydrocarbon components is recovered in said relatively less volatile fraction.

5. In a process for the separation of a gas stream containing methane, $C_2$ components, $C_3$ components and heavier hydrocarbon components into a volatile residue gas fraction containing a major portion of said methane and a relatively less volatile fraction containing a major portion of said $C_2$ components, $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_2$ components, $C_3$ components and heavier components is recovered in said relatively less volatile fraction;

the improvement wherein following cooling, said cooled stream is divided into first and second streams; and (1) said second stream is cooled sufficiently to partially condense it;

(2) said partially condensed second stream is separated thereby to provide a vapor stream and a condensed stream;

(3) said first stream is combined with at least a portion of said condensed stream to form a combined stream and said combined stream is cooled to condense substantially all of it and is thereafter expanded to said lower pressure whereby it is further cooled;

(4) said expanded cooled combined stream is thereafter supplied at a first mid-column feed position to a distillation column in a lower region of a fractionation tower;

(5) said vapor stream is expanded to said lower pressure and is supplied to said distillation column at a second mid-column feed position;

(6) a distillation stream is withdrawn from an upper region of said tower and is warmed;

(7) said warmed distillation stream is compressed to higher pressure and thereafter divided into said volatile residue gas fraction and a compressed recycle stream;

(8) said compressed recycle stream is cooled sufficiently to substantially condense it;

(9) said substantially condensed compressed recycle stream is expanded to said lower pressure and supplied to said fractionation tower at a top feed position; and

(10) the quantity and pressure of said compressed recycle stream and the quantities and temperatures of said feed streams to the column are effective to maintain tower overhead temperature at a temperature whereby the major portion of said $C_2$ components, $C_3$ components and heavier hydrocarbon components is recovered in said relatively less volatile fraction.

6. In a process for the separation of a gas stream containing methane, $C_2$ components, $C_3$ components and heavier hydrocarbon components into a volatile residue gas fraction containing a major portion of said methane and said $C_2$ components and a relatively less volatile fraction containing a major portion of said Cs components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_3$ components and heavier components is recovered in said relatively less volatile fraction;

the improvement wherein following cooling, said cooled stream is divided into first and second streams; and (1) said second stream is cooled sufficiently to partially condense it;

(2) said partially condensed second stream is separated thereby to provide a vapor stream and a condensed stream;

(3) said first stream is combined with at least a portion of said condensed stream to form a combined stream and said combined stream is cooled to condense substantially all of it and is thereafter expanded to said lower pressure whereby it is further cooled;

(4) said expanded cooled combined stream is thereafter supplied at a first mid-column feed position to a distillation column in a lower region of a fractionation tower;

(5) said vapor stream is expanded to said lower pressure and is supplied to said distillation column at a second mid-column feed position;

(6) a distillation stream is withdrawn from an upper region of said tower and is warmed;

(7) said warmed distillation stream is compressed to higher pressure and thereafter divided into said volatile residue gas fraction and a compressed recycle stream;

(8) said compressed recycle stream is cooled sufficiently to substantially condense it;

(9) said substantially condensed compressed recycle stream is expanded to said lower pressure and supplied to said fractionation tower at a top feed position; and

(10) the quantity and pressure of said compressed recycle stream and the quantities and temperatures of said feed streams to the column are effective to maintain tower overhead temperature at a temperature whereby the major portion of said $C_3$ components and heavier hydrocarbon components is recovered in said relatively less volatile fraction.

7. In a process for the separation of a gas stream containing methane, $C_2$ components, $C_3$ components and heavier hydrocarbon components into a volatile residue gas fraction containing a major portion of said methane and a relatively less volatile fraction containing a major portion of said $C_2$ components, $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_2$ components, $C_3$ components and heavier components is recovered in said relatively less volatile fraction;

the improvement wherein said gas stream is cooled sufficiently to partially condense it; and (1) said partially condensed gas stream is separated thereby to provide a vapor stream and a condensed stream;

(2) said vapor stream is thereafter divided into gaseous first and second streams;

(3) said gaseous first stream is cooled to condense substantially all of it and is thereafter expanded to said lower pressure whereby it is further cooled;

(4) said expanded cooled first stream is thereafter supplied at a first mid-column feed position to a distillation column in a lower region of a fractionation tower;

(5) said gaseous second stream is expanded to said lower pressure and is supplied to said distillation column at a second mid-column feed position;

(6) at least a portion of said condensed stream is expanded to said lower pressure and is supplied to said distillation column at a third mid-column feed position;

(7) a distillation stream is withdrawn from an upper region of said tower and is warmed;

(8) said warmed distillation stream is compressed to higher pressure and thereafter divided into said volatile residue gas fraction and a compressed recycle stream;

(9) said compressed recycle stream is cooled sufficiently to substantially condense it;

(10) said substantially condensed compressed recycle stream is expanded to said lower pressure and supplied to said fractionation tower at a top feed position; and

(11) the quantity and pressure of said compressed recycle stream and the quantities and temperatures of said feed streams to the column are effective to maintain tower overhead temperature at a temperature whereby the major portion of said $C_2$ components, $C_3$ components and heavier hydrocarbon components is recovered in said relatively less volatile fraction.

8. In a process for the separation of a gas stream containing methane, $C_2$ components, $C_3$ components and heavier hydrocarbon components into a volatile residue gas fraction containing a major portion of said methane and said $C_2$ components and a relatively less volatile fraction containing a major portion of said $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_3$ components and heavier components is recovered in said relatively less volatile fraction;

the improvement wherein said gas stream is cooled sufficiently to partially condense it; and (1) said partially condensed gas stream is separated thereby to provide a vapor stream and a condensed stream;

(2) said vapor stream is thereafter divided into gaseous first and second streams;

(3) said gaseous first stream is cooled to condense substantially all Of it and is thereafter expanded to said lower pressure whereby it is further cooled;

(4) said expanded cooled first stream is thereafter supplied at a first mid-column feed position to a distillation column in a lower region of a fractionation tower;

(5) said gaseous second stream is expanded to said lower pressure and is supplied to said distillation column at a second mid-column feed position;

(6) at least a portion of said condensed stream is expanded to said lower pressure and is supplied to said distillation column at a third mid-column feed position;

(7) a distillation stream is withdrawn from an upper region of said tower and is warmed;

(8) said warmed distillation stream is compressed to higher pressure and thereafter divided into said volatile residue gas fraction and a compressed recycle stream;

(9) said compressed recycle stream is cooled sufficiently to substantially condense it;

(10) said substantially condensed compressed recycle stream is expanded to said lower pressure and supplied to said fractionation tower at a top feed position; and

(11) the quantity and pressure of said compressed recycle stream and the quantities and temperatures of said feed streams to the column are effective to maintain tower overhead temperature at a temperature whereby the major portion of said $C_3$ components and heavier hydrocarbon components is recovered in said relatively less volatile fraction.

9. In a process for the separation of a gas stream containing methane, $C_2$ components, $C_3$ components and heavier hydrocarbon components into a volatile residue gas fraction containing a major portion of said methane and a relatively less volatile fraction containing a major portion of said $C_2$ components, $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_2$ components, $C_3$ components and heavier components is recovered in said relatively less volatile fraction;

the improvement wherein prior to cooling, said gas is divided into gaseous first and second streams; and (1) said gaseous first stream is cooled to condense substantially all of it and is thereafter expanded to said lower pressure whereby it is further cooled;

(2) said expanded cooled first stream is thereafter supplied at a first mid-column feed position to a distillation column in a lower region of a fractionation tower;

(3) said gaseous second stream is cooled under pressure sufficiently to partially condense it;

(4) said partially condensed second stream is separated thereby to provide a vapor stream and a condensed stream;

(5) said vapor stream is expanded to said lower pressure and is supplied to said distillation column at a second mid-column feed position;

(6) at least a portion of said condensed stream is expanded to said lower pressure and is supplied to said distillation column at a third mid-column feed position;

(7) a distillation stream is withdrawn from an upper region of said tower and is warmed;

(8) said warmed distillation stream is compressed to higher pressure and thereafter divided into said volatile residue gas fraction and a compressed recycle stream;

(9) said compressed recycle stream is cooled sufficiently to substantially condense it;

(10) said substantially condensed compressed recycle stream is expanded to said lower pressure and supplied to said fractionation tower at a top feed position; and

(11) the quantity and pressure of said compressed recycle stream and the quantities and temperatures of said feed streams to the column are effective to maintain tower overhead temperature at a temperature whereby the major portion of said $C_2$ components, $C_3$ components and heavier hydrocarbon components is recovered in said relatively less volatile fraction.

10. In a process for the separation of a gas stream containing methane, $C_2$ components, $C_3$ components and heavier hydrocarbon components into a volatile residue gas fraction containing a major portion of said methane and said $C_2$ components and a relatively less volatile fraction containing a major portion of said $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_3$ components and heavier components is recovered in said relatively less volatile fraction;

the improvement wherein prior to cooling, said gas is divided into gaseous first and second streams; and (1) said gaseous first stream is cooled to condense substantially all of it and is thereafter expanded to said lower pressure whereby it is further cooled;

(2) said expanded cooled first stream is thereafter supplied at a first mid-column feed position to a distillation column in a lower region of a fractionation tower;

(3) said gaseous second stream is cooled under pressure sufficiently to partially condense it;

(4) said partially condensed second stream is separated thereby to provide a vapor stream and a condensed stream;

(5) said vapor stream is expanded to said lower pressure and is supplied to said distillation column at a second mid-column feed position;

(6) at least a portion of said condensed stream is expanded to said lower pressure and is supplied to said distillation column at a third mid-column feed position;

(7) a distillation stream is withdrawn from an upper region of said tower and is warmed;

(8) said warmed distillation stream is compressed to higher pressure and thereafter divided into said volatile residue gas fraction and a compressed recycle stream;

(9) said compressed recycle stream is cooled sufficiently to substantially condense it;

(10) said substantially condensed compressed recycle stream is expanded to said lower pressure and supplied to said fractionation tower at a top feed position; and

(11) the quantity and pressure of said compressed recycle stream and the quantities and temperatures of said feed streams to the column are effective to maintain tower overhead temperature at a temperature whereby the major portion of said $C_3$ components and heavier hydrocarbon components is recovered in said relatively less volatile fraction.

11. In a process for the separation of a gas stream containing methane, $C_2$ components, $C_3$ components and heavier hydrocarbon components into a volatile residue gas fraction containing a major portion of said methane and a relatively less volatile fraction containing a major portion of said $C_2$ components, $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_2$ components, $C_3$ components and heavier components is recovered in said relatively less volatile fraction;

the improvement wherein following cooling, said cooled stream is divided into first and second streams; and (1) said first stream is cooled to condense substantially all of it and is thereafter expanded to said lower pressure whereby it is further cooled;

(2) said expanded cooled first stream is thereafter supplied at a first mid-column feed position to a distillation column in a lower region of a fractionation tower;

(3) said second stream is cooled sufficiently to partially condense it;

(4) said partially condensed second stream is separated thereby to provide a vapor stream and a condensed stream;

(5) said vapor stream is expanded to said lower pressure and is supplied to said distillation column at a second mid-column feed position;

(6) at least a portion of said condensed stream is expanded to said lower pressure and is supplied to said distillation column at a third mid-column feed position;

(7) a distillation stream is withdrawn from an upper region of said tower and is warmed;

(8) said warmed distillation stream is compressed to higher pressure and thereafter divided into said volatile residue gas fraction and a compressed recycle stream;

(9) said compressed recycle stream is cooled sufficiently to substantially condense it;

(10) said substantially condensed compressed recycle stream is expanded to said lower pressure and supplied to said fractionation tower at a top feed position; and

(11) the quantity and pressure of said compressed recycle stream and the quantities and temperatures of said feed streams to the column are effective to maintain tower overhead temperature at a temperature whereby the major portion of said $C_2$ components, $C_3$ components and heavier hydrocarbon components is recovered in said relatively less volatile fraction.

12. In a process for the separation of a gas stream containing methane, $C_2$ components, $C_3$ components and heavier hydrocarbon components into a volatile residue gas fraction containing a major portion of said methane and said $C_2$ components and a relatively less volatile fraction containing a major portion of said $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_3$ components and heavier components is recovered in said relatively less volatile fraction;

the improvement wherein following cooling, said cooled stream is divided into first and second streams; and (1) said first stream is cooled to condense substantially all of it and is thereafter expanded to said lower pressure whereby it is further cooled;

(2) said expanded cooled first stream is thereafter supplied at a first mid-column feed position to a distillation column in a lower region of a fractionation tower;

(3) said second stream is cooled sufficiently to partially condense it;

(4) said partially condensed second stream is separated thereby to provide a vapor stream and a condensed stream;

(5) said vapor stream is expanded to said lower pressure and is supplied to said distillation column at a second mid-column feed position;

(6) at least a portion of said condensed stream is expanded to said lower pressure and is supplied to said distillation column at a third mid-column feed position;

(7) a distillation stream is withdrawn from an upper region of said tower and is warmed;

(8) said warmed distillation stream is compressed to higher pressure and thereafter divided into said volatile residue gas fraction and a compressed recycle stream;

(9) said compressed recycle stream is cooled sufficiently to substantially condense it;

(10) said substantially condensed compressed recycle stream is expanded to said lower pressure and supplied to said fractionation tower at a top feed position; and

(11) the quantity and pressure of said compressed recycle stream and the quantities and temperatures of said feed streams to the column are effective to maintain tower overhead temperature at a temperature whereby the major portion of said $C_3$ components and heavier hydrocarbon components is recovered in said relatively less volatile fraction.

13. In a process for the separation of a gas stream containing methane, $C_2$ components, $C_3$ components and heavier hydrocarbon components into a volatile residue gas fraction containing a major portion of said methane and a relatively less volatile fraction containing a major portion of said $C_2$ components, $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_2$ components, $C_3$ components and heavier components is recovered in said relatively less volatile fraction;

the improvement wherein prior to cooling, said gas is divided into gaseous first and second streams; and (1) said gaseous first stream is cooled to condense substantially all of it and is thereafter expanded to said lower pressure whereby it is further cooled;

(2) said expanded cooled first stream is thereafter supplied at a first mid-column feed position to a distillation column in a lower region of a fractionation tower;

(3) said gaseous second stream is cooled under pressure and then expanded to said lower pressure and supplied to said distillation column at a second mid-column feed position;

(4) a distillation stream is withdrawn from an upper region of said tower and is warmed;

(5) said warmed distillation stream is compressed to higher pressure and thereafter divided into said volatile residue gas fraction and a compressed recycle stream;

(6) said compressed recycle stream is cooled sufficiently to substantially condense it;

(7) said substantially condensed compressed recycle stream is expanded to said lower pressure and supplied to said fractionation tower at a top feed position; and (8) the quantity and pressure of said compressed recycle stream and the quantities and temperatures of said feed streams to the column are effective to maintain tower overhead temperature at a temperature whereby the major portion of said $C_2$ components, $C_3$ components and heavier hydrocarbon components is recovered in said relatively less volatile fraction.

14. In a process for the separation of a gas stream containing methane, $C_2$ components, $C_3$ components and heavier hydrocarbon components into a volatile residue gas fraction containing a major portion of said methane and said $C_2$ components and a relatively less volatile fraction containing a major portion of said $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_3$ components and heavier components is recovered in said relatively less volatile fraction;

the improvement wherein prior to cooling, said gas is divided into gaseous first and second streams; and (1) said gaseous first stream is cooled to condense substantially all of it and is thereafter expanded to said lower pressure whereby it is further cooled;

(2) said expanded cooled first stream is thereafter supplied at a first mid-column feed position to a distillation column in a lower region of a fractionation tower;

(3) said gaseous second stream is cooled under pressure and then expanded to said lower pressure and supplied to said distillation column at a second mid-column feed position;

(4) a distillation stream is withdrawn from an upper region of said tower and is warmed;

(5) said warmed distillation stream is compressed to higher pressure and thereafter divided into said volatile residue gas fraction and a compressed recycle stream;

(6) said compressed recycle stream is cooled sufficiently to substantially condense it;

(7) said substantially condensed compressed recycle stream is expanded to said lower pressure and supplied to said fractionation tower at a top feed position; and (8) the quantity and pressure of said compressed recycle stream and the quantities and temperatures of said feed streams to the column are effective to maintain tower overhead temperature at a temperature whereby the major portion of said $C_3$ components and heavier hydrocarbon components is recovered in said relatively less volatile fraction.

15. In a process for the separation of a gas stream containing methane, $C_2$ components, $C_3$ components and heavier hydrocarbon components into a volatile residue gas fraction containing a major portion of said methane and a relatively less volatile fraction containing a major portion of said $C_2$ components, $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_2$ components, $C_3$ components and heavier components is recovered in said relatively less volatile fraction;

the improvement wherein following cooling, said cooled stream is divided into first and second streams; and (1) said first stream is cooled to condense substantially all of it and is thereafter expanded to said lower pressure whereby it is further cooled;

(2) said expanded cooled first stream is thereafter supplied at a first mid-column feed position to a distillation column in a lower region of a fractionation tower;

(3) said second stream is expanded to said lower pressure and is supplied to said distillation column at a second mid-column feed position;

(4) a distillation stream is withdrawn from an upper region of said tower and is warmed;

(5) said warmed distillation stream is compressed to higher pressure and thereafter divided into said volatile residue gas fraction and a compressed recycle stream;

(6) said compressed recycle stream is cooled sufficiently to substantially condense it;

(7) said substantially condensed compressed recycle stream is expanded to said lower pressure and supplied to said fractionation tower at a top feed position; and (8) the quantity and pressure of said compressed recycle stream and the quantities and temperatures of said feed streams to the column are effective to maintain tower overhead temperature at a temperature whereby the major portion of said $C_2$ components, $C_3$ components and heavier hydrocarbon components is recovered in said relatively less volatile fraction.

16. In a process for the separation of a gas stream containing methane, $C_2$ components, $C_3$ components and heavier hydrocarbon components into a volatile residue gas fraction containing a major portion of said methane and said $C_2$ components and a relatively less volatile fraction containing a major portion of said $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_3$ components and heavier components is recovered in said relatively less volatile fraction;

the improvement wherein following cooling, said cooled stream is divided into first and second streams; and (1) said first stream is cooled to condense substantially all of it and is thereafter expanded to said lower pressure whereby it is further cooled;

(2) said expanded cooled first stream is thereafter supplied at a first mid-column feed position to a distillation column in a lower region of a fractionation tower;

(3) said second stream is expanded to said lower pressure and is supplied to said distillation column at a second mid-column feed position;

(4) a distillation stream is withdrawn from an upper region of said tower and is warmed;

(5) said warmed distillation stream is compressed to higher pressure and thereafter divided into said volatile residue gas fraction and a compressed recycle stream;

(6) said compressed recycle stream is cooled sufficiently to substantially condense it;

(7) said substantially condensed compressed recycle stream is expanded to said lower pressure and supplied to said fractionation tower at a top feed position; and (8) the quantity and pressure of said compressed recycle stream and the quantities and temperatures of said feed streams to the column are effective to maintain tower overhead temperature at a temperature whereby the major portion of said $C_3$ components and heavier hydrocarbon components is recovered in said relatively less volatile fraction.

17. The improvement according to claim 1, 2, 3, 4, 5, or 6 wherein at least a portion of said condensed stream is expanded to said lower pressure and then supplied to said distillation column at a third mid-column feed position.

18. The improvement according to claim 17 wherein (a) said warmed distillation stream is divided into said volatile residue gas fraction and a recycle stream prior to compression; and (b) said recycle stream is thereafter compressed to form said compressed recycle stream.

19. The improvement according to claim 17 wherein (a) said distillation stream is divided into said volatile residue gas fraction and a recycle stream prior to heating; and (b) said recycle stream is thereafter compressed to form said compressed recycle stream.

20. The improvement according to claim 1, 2, 3, 4, 5, or 6 wherein at least a portion of said condensed stream is expanded to said lower pressure, heated and then supplied to said distillation column at a third mid-column feed position.

21. The improvement according to claim 20 wherein (a) said warmed distillation stream is divided into said volatile residue gas fraction and a recycle stream prior to compression; and (b) said recycle stream is thereafter compressed to form said compressed recycle stream.

22. The improvement according to claim 20 wherein (a) said distillation stream is divided into said volatile residue gas fraction and a recycle stream prior to heating; and (b) said recycle stream is thereafter compressed to form said compressed recycle stream.

23. The improvement according to claim 1 or 2 wherein at least portions of two or more of said combined stream, said second stream and said condensed stream are combined to form a second combined stream and said second combined stream is supplied to said column at a mid-column feed position.

24. The improvement according to claim 23 wherein (a) said warmed distillation stream is divided into said volatile residue gas fraction and a recycle stream prior to compression; and (b) said recycle stream is thereafter compressed to form said compressed recycle stream.

25. The improvement according to claim 23 wherein (a) said distillation stream is divided into said volatile residue gas fraction and a recycle stream prior to heating; and (b) said recycle stream is thereafter compressed to form said compressed recycle stream.

26. The improvement according to claim 3, 4, 5 or 6 wherein at least portions of two or more of said combined stream, said vapor stream and said condensed stream are combined to form a second combined stream and said second combined stream is supplied to said column at a mid-column feed position.

27. The improvement according to claim 26 wherein (a) said warmed distillation stream is divided into said volatile residue gas fraction and a recycle stream prior to compression; and (b) said recycle stream is thereafter compressed to form said compressed recycle stream.

28. The improvement according to claim 26 wherein (a) said distillation stream is divided into said volatile residue gas fraction and a recycle stream prior to heating; and (b) said recycle stream is thereafter compressed to form said compressed recycle stream.

29. The improvement according to claim 7 or 8 wherein at least portions of two or more of said first stream, said second stream and said condensed stream are combined to form a combined stream and said combined stream is supplied to said column at a mid-column feed position.

30. The improvement according to claim 29 wherein (a) said warmed distillation stream is divided into said volatile residue gas fraction and a recycle stream prior to compression; and (b) said recycle stream is thereafter compressed to form said compressed recycle stream.

31. The improvement according to claim 29 wherein (a) said distillation stream is divided into said volatile residue gas fraction and a recycle stream prior to heating; and (b) said recycle stream is thereafter compressed to form said compressed recycle stream.

32. The improvement according to claim 9, 10, 11 or 12 wherein at least portions of two or more of said first stream, said vapor stream and said condensed stream are combined to form a combined stream and said combined stream is supplied to said column at a mid-column feed position.

33. The improvement according to claim 32 wherein (a) said warmed distillation stream is divided into said volatile residue gas fraction and a recycle stream prior to compression; and (b) said recycle stream is thereafter compressed to form said compressed recycle stream.

34. The improvement according to claim 32 wherein (a) said distillation stream is divided into said volatile residue gas fraction and a recycle stream prior to heating; and (b) said recycle stream is thereafter compressed to form said compressed recycle stream.

35. The improvement according to claim 13, 14, 15 or 16 wherein at least portions of said first stream and said second stream are combined to form a combined stream and said combined stream is supplied to said column at a mid-column feed position.

36. The improvement according to claim 35 wherein (a) said warmed distillation stream is divided into said volatile residue gas fraction and a recycle stream prior to compression; and (b) said recycle stream is thereafter compressed to form said compressed recycle stream.

37. The improvement according to claim 35 wherein (a) said distillation stream is divided into said volatile residue gas fraction and a recycle stream prior to heating; and (b) said recycle stream is thereafter compressed to form said compressed recycle stream.

38. The improvement according to claim 7, 8, 9, 10, 11 or 12 wherein (a) said condensed stream is cooled prior to said expansion and then divided into first and second liquid portions;

(b) said first liquid portion is expanded to said lower pressure and supplied to said column at a mid-column feed position; and (c) said second liquid portion is expanded to said lower pressure and supplied to said column at a higher mid-column feed position.

39. The improvement according to claim 38 wherein (a) said warmed distillation stream is divided into said volatile residue gas fraction and a recycle stream prior to compression; and (b) said recycle stream is thereafter compressed to form said compressed recycle stream.

40. The improvement according to claim 38 wherein (a) said distillation stream is divided into said volatile residue gas fraction and a recycle stream prior to heating; and (b) said recycle stream is thereafter compressed to form said compressed recycle stream.

41. The improvement according to claim 38 wherein (a) at least part of said second liquid portion is combined with said first stream to form a combined stream and said combined stream is thereafter supplied to said column at a first mid-column feed position; and (b) the remainder of said second liquid portion is expanded to said lower pressure and supplied to said column at another mid-column feed position.

42. The improvement according to claim 41 wherein (a) said warmed distillation stream is divided into said volatile residue gas fraction and a recycle stream prior to compression; and (b) said recycle stream is thereafter compressed to form said compressed recycle stream.

43. The improvement according to claim 41 wherein (a) said distillation stream is divided into said volatile residue gas fraction and a recycle stream prior to heating; and (b) said recycle stream is thereafter compressed to form said compressed recycle stream.

44. The improvement according to claim 38 wherein said first liquid portion is expanded, directed in heat exchange relation with said condensed stream and is then supplied to said column at a mid-column feed position.

45. The improvement according to claim 44 wherein (a) said warmed distillation stream is divided into said volatile residue gas fraction and a recycle stream prior to compression; and (b) said recycle stream is thereafter compressed to form said compressed recycle stream.

46. The improvement according to claim 44 wherein (a) said distillation stream is divided into said volatile residue gas fraction and a recycle stream prior to heating; and (b) said recycle stream is thereafter compressed to form said compressed recycle stream.

47. The improvement according to claim 38 wherein said second liquid portion is expanded to said lower pressure and at least a part of said expanded second liquid portion is combined with said expanded cooled first stream to form a combined stream and said combined stream is thereafter supplied to said column at a first mid-column feed position.

48. The improvement according to claim 47 wherein (a) said warmed distillation stream is divided into said volatile residue gas fraction and a recycle stream prior to compression; and (b) said recycle stream is thereafter compressed to form said compressed recycle stream.

49. The improvement according to claim 47 wherein (a) said distillation stream is divided into said volatile residue gas fraction and a recycle stream prior to heating; and (b) said recycle stream is thereafter compressed to form said compressed recycle stream.

50. The improvement according to claim 7, 8, 9, 10, 11 or 12 wherein said expanded condensed stream is heated prior to being supplied to said distillation column.

51. The improvement according to claim 50 wherein (a) said warmed distillation stream is divided into said volatile residue gas fraction and a recycle stream prior to compression; and (b) said recycle stream is thereafter compressed to form said compressed recycle stream.

52. The improvement according to claim 50 wherein (a) said distillation stream is divided into said volatile residue gas fraction and a recycle stream prior to heating; and (b) said recycle stream is thereafter compressed to form said compressed recycle stream.

53. The improvement according to claim 1, 2, 7, 8, 13, 14, 15 or 16 wherein at least a portion of said second stream is heated after expansion to said lower pressure.

54. The improvement according to claim 53 wherein (a) said warmed distillation stream is divided into said volatile residue gas fraction and a recycle stream prior to compression; and (b) said recycle stream is thereafter compressed to form said compressed recycle stream.

55. The improvement according to claim 53 wherein (a) said distillation stream is divided into said volatile residue gas fraction and a recycle stream prior to heating; and (b) said recycle stream is thereafter compressed to form said compressed recycle stream.

56. The improvement according to claim 3, 4, 5, 6, 9, 10, 11 or 12 wherein at least a portion of said vapor stream is heated after expansion to said lower pressure.

57. The improvement according to claim 56 wherein (a) said warmed distillation stream is divided into said volatile residue gas fraction and a recycle stream prior to compression; and (b) said recycle stream is thereafter compressed to form said compressed recycle stream.

58. The improvement according to claim 56 wherein (a) said distillation stream is divided into said volatile residue gas fraction and a recycle stream prior to heating; and (b) said recycle stream is thereafter compressed to form said compressed recycle stream.

59. In an apparatus for the separation of a gas containing methane, $C_2$ components, $C_3$ components and heavier hydrocarbon components into a volatile residue gas fraction containing a major portion of said methane and a relatively less volatile fraction containing a major portion of said $C_2$ components, $C_3$ components and heavier components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a fractionation tower connected to said first expansion means to receive said further cooled stream therefrom;

the improvement wherein said apparatus includes (1) first cooling means adapted to cool said feed gas under pressure sufficiently to partially condense it;

(2) separation means connected to said first cooling means to receive said partially condensed feed and to separate it into a vapor and a condensed stream;

(3) first dividing means connected to said separation means to receive said vapor and to divide said vapor into first and second streams;

(4) combining means connected to combine said condensed stream and said first stream into a combined stream;

(5) second cooling means connected to said combining means to receive said combined stream and to cool it sufficiently to substantially condense it;

(6) second expansion means connected to said second cooling means to receive said substantially condensed combined stream and to expand it to said lower pressure; said second expansion means being further connected to a distillation column in a lower region of said fractionation tower to supply said expanded combined stream to said distillation column at a first mid-column feed position;

(7) said first expansion means being connected to said first dividing means to receive said second stream and to expand it to said lower pressure; said first expansion means being further connected to said distillation column to supply said expanded second stream to said distillation column at a second mid-column feed position;

(8) heating means connected to said fractionation tower to receive a distillation stream which rises in the fractionation tower and to heat it;

(9) compressing means connected to said heating means to receive said heated distillation stream and to compress it;

(10) second dividing means connected to said compressing means to receive said heated compressed distillation stream and to divide it into said volatile residue gas fraction and a compressed recycle stream;

(11) third cooling means connected to said second dividing means to receive said compressed recycle stream and to cool it sufficiently to substantially condense it;

(12) third expansion means connected to said third cooling means to receive said substantially condensed compressed recycle stream and to expand it to said lower pressure; said third expansion means being further connected to said fractionation tower to supply said expanded condensed recycle stream to the tower at a top feed position; and

(13) control means adapted to regulate the pressure of said compressed recycle stream and the quantities and temperatures of said combined stream, said second stream and said recycle stream to maintain column overhead temperature at a temperature whereby the major portion of said $C_2$ components, $C_3$ components and heavier components is recovered in said relatively less volatile fraction.

60. In an apparatus for the separation of a gas containing methane, $C_2$ components, $C_3$ components and heavier hydrocarbon components into a volatile residue gas fraction containing a major portion of said methane and said $C_2$ components and a relatively less volatile fraction containing a major portion of said $C_3$ components and heavier components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a fractionation tower connected to said first expansion means to receive said further cooled stream therefrom;

the improvement wherein said apparatus includes (1) first cooling means adapted to cool said feed gas under pressure sufficiently to partially condense it;

(2) separation means connected to said first cooling means to receive said partially condensed feed and to separate it into a vapor and a condensed stream;

(3) first dividing means connected to said separation means to receive said vapor and to divide said vapor into first and second streams;

(4) combining means connected to combine said condensed stream and said first stream into a combined stream;

(5) second cooling means connected to said combining means to receive said combined stream and to cool it sufficiently to substantially condense it;

(6) second expansion means connected to said second cooling means to receive said substantially condensed combined stream and to expand it to said lower pressure; said second expansion means being further connected to a distillation column in a lower region of said fractionation tower to supply said expanded combined stream to said distillation column at a first mid-column feed position;

(7) said first expansion means being connected to said first dividing means to receive said second stream and to expand it to said lower pressure; said first expansion means being further connected to said distillation column to supply said expanded second stream to said distillation column at a second mid-column feed position;

(8) heating means connected to said fractionation tower to receive a distillation stream which rises in the fractionation tower and to heat it;

(9) compressing means connected to said heating means to receive said heated distillation stream and to compress it;

(10) second dividing means connected to said compressing means to receive said heated compressed distillation stream and to divide it into said volatile residue gas fraction and a compressed recycle stream;

(11) third cooling means connected to said second dividing means to receive said compressed recycle stream and to cool it sufficiently to substantially condense it;

(12) third expansion means connected to said third cooling means to receive said substantially condensed compressed recycle stream and to expand it to said lower pressure; said third expansion means being further connected to said fractionation tower to supply said expanded condensed recycle stream to the tower at a top feed position; and

(13) control means adapted to regulate the pressure of said compressed recycle stream and the quantities and temperatures of said combined stream, said second stream and said recycle stream to maintain column overhead temperature at a temperature whereby the major portion of said $C_3$ components and heavier components is recovered in said relatively less volatile fraction.

61. In an apparatus for the separation of a gas containing methane, $C_2$ components, $C_3$ components and heavier hydrocarbon components into a volatile residue gas fraction containing a major portion of said methane and a relatively less volatile fraction containing a major portion of said $C_2$ components, $C_3$ components and heavier components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a fractionation tower connected to said first expansion means to receive said further cooled stream therefrom;

the improvement wherein said apparatus includes (1) first dividing means prior to said first cooling means to divide said feed gas into a first gaseous stream and a second gaseous stream;

(2) second cooling means connected to said dividing means to receive said first stream and to cool it sufficiently to substantially condense it;

(3) second expansion means connected to said second cooling means to receive said substantially condensed first stream and to expand it to said lower pressure; said second expansion means being further connected to a distillation column in a lower region of said fractionation tower to supply said expanded first stream to said distillation column at a first mid-column feed position;

(4) said first cooling means being connected to said first dividing means to receive said second stream and to cool it;

(5) said first expansion means being connected to said first cooling means to receive said cooled second stream and to expand it to said lower pressure; said first expansion means being further connected to said distillation column to supply said expanded second stream to said distillation column at a second mid-column feed position;

(6) heating means connected to said fractionation tower to receive a distillation stream which rises in the fractionation tower and to heat it;

(7) compressing means connected to said heating means to receive said heated distillation stream and to compress it;

(8) second dividing means connected to said compressing means to receive said heated compressed distillation stream and to divide it into said volatile residue gas fraction and a compressed recycle stream;

(9) third cooling means connected to said second dividing means to receive said compressed recycle stream and to cool it sufficiently to substantially condense it;

(10) third expansion means connected to said third cooling means to receive said substantially condensed compressed recycle stream and to expand it to said lower pressure; said third expansion means being further connected to said fractionation tower to supply said expanded condensed recycle stream to the tower at a top feed position; and

(11) control means adapted to regulate the pressure of said compressed recycle stream and the quantities and temperatures of said first stream, said second stream and said recycle stream to maintain column overhead temperature at a temperature whereby the major portion of said $C_2$ components, $C_3$ components and heavier components is recovered in said relatively less volatile fraction.

62. In an apparatus for the separation of a gas containing methane, $C_2$ components, $C_3$ components and heavier hydrocarbon components into a volatile residue gas fraction containing a major portion of said methane and said $C_2$ components and a relatively less volatile fraction containing a major portion of said $C_3$ components and heavier components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a fractionation tower connected to said first expansion means to receive said further cooled stream therefrom;

the improvement wherein said apparatus includes (1) first dividing means prior to said first cooling means to divide said feed gas into a first gaseous stream and a second gaseous stream;

(2) second cooling means connected to said dividing means to receive said first stream and to cool it sufficiently to substantially condense it;

(3) second expansion means connected to said second cooling means to receive said substantially condensed first stream and to expand it to said lower pressure; said second expansion means being further connected to a distillation column in a lower region of said fractionation tower to supply said expanded first stream to said distillation column at a first mid-column feed position;

(4) said first cooling means being connected to said first dividing means to receive said second stream and to cool it;

(5) said first expansion means being connected to said first cooling means to receive said cooled second stream and to expand it to said lower pressure; said first expansion means being further connected to said distillation column to supply said expanded second stream to said distillation column at a second mid-column feed position;

(6) heating means connected to said fractionation tower to receive a distillation stream which rises in the fractionation tower and to heat it;

(7) compressing means connected to said heating means to receive said heated distillation stream and to compress it;

(8) second dividing means connected to said compressing means to receive said heated compressed distillation stream and to divide it into said volatile residue gas fraction and a compressed recycle stream;

(9) third cooling means connected to said second dividing means to receive said compressed recycle stream and to cool it sufficiently to substantially condense it;

(10) third expansion means connected to said third cooling means to receive said substantially condensed compressed recycle stream and to expand it to said lower pressure; said third expansion means being further connected to said fractionation tower to supply said expanded condensed recycle stream to the tower at a top feed position; and

(11) control means adapted to regulate the pressure of said compressed recycle stream and the quantities and temperatures of said first stream, said second stream and said recycle stream to maintain column overhead temperature at a temperature whereby the major portion of said $C_3$ components and heavier components is recovered in said relatively less volatile fraction.

63. In an apparatus for the separation of a gas containing methane, $C_2$ components, $C_3$ components and heavier hydrocarbon components into a volatile residue gas fraction containing a major portion of said methane and a relatively less volatile fraction containing a major portion of said $C_2$ components, $C_3$ components and heavier components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a fractionation tower connected to said first expansion means to receive said further cooled stream therefrom;

the improvement wherein said apparatus includes (1) first dividing means after said first cooling means to divide said cooled stream into a first stream and a second stream;

(2) second cooling means connected to said dividing means to receive said first stream and to cool it sufficiently to substantially condense it;

(3) second expansion means connected to said second cooling means to receive said substantially condensed first stream and to expand it to said lower pressure; said second expansion means being further connected to a distillation column in a lower region of said fractionation tower to supply said expanded first stream to said distillation column at a first mid-column feed position;

(4) said first expansion means being connected to said first dividing means to receive said second stream and to expand it to said lower pressure; said first expansion means being further connected to said distillation column to supply said expanded second stream to said distillation column at a second mid-column feed position;

(5) heating means connected to said fractionation tower to receive a distillation stream which rises in the fractionation tower and to heat it;

(6) compressing means connected to said heating means to receive said heated distillation stream and to compress it;

(7) second dividing means connected to said compressing means to receive said heated compressed distillation stream and to divide it into said volatile residue gas fraction and a compressed recycle stream;

(8) third cooling means connected to said second dividing means to receive said compressed recycle stream and to cool it sufficiently to substantially condense it;

(9) third expansion means connected to said third cooling means to receive said substantially condensed compressed recycle stream and to expand it to said lower pressure; said third expansion means being further connected to said fractionation tower to supply said expanded condensed recycle stream to the tower at a top feed position; and

(10) control means adapted to regulate the pressure of said compressed recycle stream and the quantities and temperatures of said first stream, said second stream and said recycle stream to maintain column overhead temperature at a temperature whereby the major portion of said $C_2$ components, $C_3$ components and heavier components is recovered in said relatively less volatile fraction.

64. In an apparatus for the separation of a gas containing methane, $C_2$ components, $C_3$ components and heavier hydrocarbon components into a volatile residue gas fraction containing a major portion of said methane and said $C_2$ components and a relatively less volatile fraction containing a major portion of said $C_3$ components and heavier components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a fractionation tower connected to said first expansion means to receive said further cooled stream therefrom;

the improvement wherein said apparatus includes (1) first dividing means after said first cooling means to divide said cooled stream into a first stream and a second stream;

(2) second cooling means connected to said dividing means to receive said first stream and to cool it sufficiently to substantially condense it;

(3) second expansion means connected to said second cooling means to receive said substantially condensed first stream and to expand it to said lower pressure; said second expansion means being further connected to a distillation column in a lower region of said fractionation tower to supply said expanded first stream to said distillation column at a first mid-column feed position;

(4) said first expansion means being connected to said first dividing means to receive said second stream and to expand it to said lower pressure; said first expansion means being further connected to said distillation column to supply said expanded second stream to said distillation column at a second mid-column feed position;

(5) heating means connected to said fractionation tower to receive a distillation stream which rises in the fractionation tower and to heat it;

(6) compressing means connected to said heating means to receive said heated distillation stream and to compress it;

(7) second dividing means connected to said compressing means to receive said heated compressed distillation stream and to divide it into said volatile residue gas fraction and a compressed recycle stream;

(8) third cooling means connected to said second dividing means to receive said compressed recycle stream and to cool it sufficiently to substantially condense it;

(9) third expansion means connected to said third cooling means to receive said substantially condensed compressed recycle stream and to expand it to said lower pressure; said third expansion means being further connected to said fractionation tower to supply said expanded condensed recycle stream to the tower at a top feed position; and

(10) control means adapted to regulate the pressure of said compressed recycle stream and the quantities and temperatures of said first stream, said second stream and said recycle stream to maintain column overhead temperature at a temperature whereby the major portion of said $C_3$ components and heavier components is recovered in said relatively less volatile fraction.

65. In a process for the separation of a gas stream containing methane, $C_2$ components, $C_3$ components and heavier hydrocarbon components into a volatile residue gas fraction containing a major portion of said methane and a relatively less volatile fraction containing a major portion of said $C_2$ components, $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_2$ components, $C_3$ components and heavier components is recovered in said relatively less volatile fraction;

the improvement wherein said gas stream is cooled sufficiently to partially condense it; and (1) said partially condensed gas stream is separated thereby to provide a vapor stream and a condensed stream;

(2) said vapor stream is thereafter divided into gaseous first and second streams;

(3) said gaseous first stream is combined with at least a portion of said condensed stream to form a combined stream and said combined stream is cooled to condense substantially all of it and is thereafter expanded to said lower pressure whereby it is further cooled;

(4) said expanded cooled combined stream is thereafter supplied at a first mid-column feed position to a distillation column in a lower region of a fractionation tower;

(5) said gaseous second stream is expanded to said lower pressure and is supplied to said distillation column at a second mid-column feed position;

(6) a distillation stream is withdrawn from an upper region of said tower and is divided into a volatile residue gas fraction and a recycle stream;

(7) said recycle stream is compressed to form a compressed recycle stream;

(8) said compressed recycle stream is cooled with at least a portion of said volatile residue gas fraction sufficiently to substantially condense it;

(9) said substantially condensed compressed recycle stream is expanded to said lower pressure and supplied to said fractionation tower at a top feed position; and

(10) the quantity and pressure of said compressed recycle stream and the quantities and temperatures of said feed streams to the column are effective to maintain tower overhead temperature at a temperature whereby the major portion of said $C_2$ components, $C_s$ components and heavier hydrocarbon components is recovered in said relatively less volatile fraction.

66. In a process for the separation of a gas stream containing methane, $C_2$ components, $C_3$ components and heavier hydrocarbon components into a volatile residue gas fraction containing a major portion of said methane and said $C_2$ components and a relatively less volatile fraction containing a major portion of said $C_3$ components and heavier components, in which process (a) said gee stream is cooled under pressure to provide a cooled stream;

(b) said cooled stream is expanded to a lower pressure whereby it is further cooled; and (c) said further cooled stream is fractionated at said lower pressure whereby the major portion of said $C_3$ components and heavier components is recovered in said relatively less volatile fraction;

the improvement wherein said gas stream is cooled sufficiently to partially condense it; and (1) said partially condensed gas stream is separated thereby to provide a vapor stream and a condensed stream;

(2) said vapor stream is thereafter divided into gaseous first and second streams;

(3) said gaseous first stream is combined with at least a portion of said condensed stream to form a combined stream and said combined stream is cooled to condense substantially all of it and is thereafter expanded to said lower pressure whereby it is further cooled;

(4) said expanded cooled combined stream is thereafter supplied at a first mid-column feed position to a distillation column in a lower region of a fractionation tower;

(5) said gaseous second stream is expanded to said lower pressure and is supplied to said distillation column at a second mid-column feed position;

(6) a distillation stream is withdrawn from an upper region of said tower and is divided into a volatile residue gas fraction and a recycle stream;

(7) said recycle stream is compressed to form a compressed recycle stream;

(8) said compressed recycle stream is cooled with at least a portion of said volatile residue gas fraction sufficiently to substantially condense it;

(9) said substantially condensed compressed recycle stream is expanded to said lower pressure and supplied to said fractionation tower at a top feed position; and

(10) the quantity and pressure of said compressed recycle stream and the quantities and temperatures of said feed streams to the column are effective to maintain tower overhead temperature at a temperature whereby the major portion of said $C_3$ components and heavier hydrocarbon components is recovered in said relatively less volatile fraction.

67. In a process for the separation of a gas stream containing methane, $C_2$ components, $C_3$ components and heavier hydrocarbon components into a volatile residue gas fraction containing a major portion of said methane and a relatively less volatile fraction containing a major portion of said $C_2$ components, $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_2$ components, $C_3$ components and heavier components is recovered in said relatively less volatile fraction;

the improvement wherein prior to cooling, said gas is divided into gaseous first and second streams; and (1) said gaseous second stream is cooled under pressure sufficiently to partially condense it;

(2) said partially condensed second stream is separated thereby to provide a vapor stream and a condensed stream;

(3) said gaseous first stream is cooled and then combined with at least a portion of said condensed stream to form a combined stream and said combined stream is cooled to condense substantially all of it and is thereafter expanded to said lower pressure whereby it is further cooled;

(4) said expanded cooled combined stream is thereafter supplied at a first mid-column feed position to a distillation column in a lower region of a fractionation tower;

(5) said vapor stream is expanded to said lower pressure and is supplied to said distillation column at a second mid-column feed position;

(6) a distillation stream is withdrawn from an upper region of said tower and is divided into a volatile residue gas fraction and a recycle stream;

(7) said recycle stream is compressed to form a compressed recycle stream;

(8) said compressed recycle stream is cooled with at least a portion of said volatile residue gas fraction sufficiently to substantially condense it;

(9) said substantially condensed compressed recycle stream is expanded to said lower pressure and supplied to said fractionation tower at a top feed position; and

(10) the quantity and pressure of said compressed recycle stream and the quantities and temperatures of said feed streams to the column are effective to maintain tower overhead temperature at a temperature whereby the major portion of said $C_2$ components, $C_3$ components and heavier hydrocarbon components is recovered in said relatively less volatile fraction.

68. In a process for the separation of a gas stream containing methane, $C_2$ components, $C_3$ components and heavier hydrocarbon components into a volatile residue gas fraction containing a major portion of said methane and said $C_2$ components and a relatively less volatile fraction containing a major portion of said $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_3$ components and heavier components is recovered in said relatively less volatile fraction;

the improvement wherein prior to cooling, said gas is divided into gaseous first and second streams; and (1) said gaseous second stream is cooled under pressure sufficiently to partially condense it;

(2) said partially condensed second stream is separated thereby to provide a vapor stream and a condensed stream;

(3) said gaseous first stream is cooled and then combined with at least a portion of said condensed stream to form a combined stream and said combined stream is cooled to condense substantially all of it and is thereafter expanded to said lower pressure whereby it is further cooled;

(4) said expanded cooled combined stream thereafter supplied at a first mid-column feed position to a distillation column in a lower region of a fractionation tower;

(5) said vapor stream is expanded to said lower pressure and is supplied to said distillation column at a second mid-column feed position;

(6) a distillation stream is withdrawn from an upper region of said tower and is divided into a volatile residue gas fraction and a recycle stream;

(7) said recycle stream is compressed to form a compressed recycle stream;

(8) said compressed recycle stream is cooled with at least a portion of said volatile residue gas fraction sufficiently to substantially condense it;

(9) said substantially condensed compressed recycle stream is expanded to said lower pressure and supplied to said fractionation tower at a top feed position; and

(10) the quantity and pressure of said compressed recycle stream and the quantities and temperatures of said feed streams to the column are effective to maintain tower overhead temperature at a temperature whereby the major portion of said $C_3$ components and heavier hydrocarbon components is recovered in said relatively less volatile fraction.

69. In a process for the separation of a gas stream containing methane, $C_2$ components, $C_3$ components and heavier hydrocarbon components into a volatile residue gas fraction containing a major portion of said methane and a relatively less volatile fraction containing a major portion of said $C_2$ components, $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_2$ components, $C_3$ components and heavier components is recovered in said relatively less volatile fraction;

the improvement wherein following cooling, said cooled stream is divided into first and second streams; and (1) said second stream is cooled sufficiently to partially condense it;

(2) said partially condensed second stream is separated thereby to provide a vapor stream and a condensed stream;

(3) said first stream is combined with at least a portion of said condensed stream to form a combined stream and said combined stream is cooled to condense substantially all of it and is thereafter expanded to said lower pressure whereby it is further cooled;

(4) said expanded cooled combined stream is thereafter supplied at a first mid-column feed position to a distillation column in a lower region of a fractionation tower;

(5) said vapor stream is expanded to said lower pressure and is supplied to said distillation column at a second mid-column feed position;

(6) a distillation stream is withdrawn from an upper region of said tower and is divided into a volatile residue gas fraction and a recycle stream;

(7) said recycle stream is compressed to form a compressed recycle stream;

(8) said compressed recycle stream is cooled with at least a portion of said volatile residue gas fraction sufficiently to substantially condense it;

(9) said substantially condensed compressed recycle stream is expanded to said lower pressure and supplied to said fractionation tower at a top feed position; and

(10) the quantity and pressure of said compressed recycle stream and the quantities and temperatures of said feed streams to the column are effective to maintain tower overhead temperature at a temperature whereby the major portion of said $C_2$ components, $C_3$ components and heavier hydrocarbon components is recovered in said relatively less volatile fraction.

70. In a process for the separation of a gas stream containing methane, $C_2$ components, $C_3$ components and heavier hydrocarbon components into a volatile residue gas fraction containing a major portion of said methane and said $C_2$ components and a relatively less volatile fraction containing a major portion of said $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_3$ components and heavier components is recovered in said relatively less volatile fraction;

the improvement wherein following cooling, said cooled stream is divided into first and second streams; and (1) said second stream is cooled sufficiently to partially condense it;

(2) said partially condensed second stream is separated thereby to provide a vapor stream and a condensed stream;

(3) said first stream is combined with at least a portion of said condensed stream to form a combined stream and said combined stream is cooled to condense substantially all of it and is thereafter expanded to said lower pressure whereby it is further cooled;

(4) said expanded cooled combined stream is thereafter supplied at a first mid-column feed position to a distillation column in a lower region of a fractionation tower;

(5) said vapor stream is expanded to said lower pressure and is supplied to said distillation column at a second mid-column feed position;

(6) a distillation stream is withdrawn from an upper region of said tower and is divided into a volatile residue gas fraction and a recycle stream;

(7) said recycle stream is compressed to form a compressed recycle stream;

(8) said compressed recycle stream is cooled with at least a portion of said volatile residue gas fraction sufficiently to substantially condense it;

(9) said substantially condensed compressed recycle stream is expanded to said lower pressure and supplied to said fractionation tower at a top feed position; and

(10) the quantity and pressure of said compressed recycle stream and the quantities and temperatures of said feed streams to the column are effective to maintain tower overhead temperature at a temperature whereby the major portion of said $C_3$ components and heavier hydrocarbon components is recovered in said relatively less volatile fraction.

71. In a process for the separation of a gas stream containing methane, $C_2$ components, $C_3$ components and heavier hydrocarbon components into a volatile residue gas fraction containing a major portion of said methane and a relatively less volatile fraction containing a major portion of said $C_2$ components, $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_2$ components, $C_3$ components and heavier components is recovered in said relatively less volatile fraction;

the improvement wherein said gas stream is cooled sufficiently to partially condense it; and (1) said partially Condensed gas stream is separated thereby to provide a vapor stream and a condensed stream;

(2) said vapor stream is thereafter divided into gaseous first and second streams;

(3) said gaseous first stream is cooled to condense substantially all of it and is thereafter expanded to said lower pressure whereby it is further cooled;

(4) said expanded cooled first stream is thereafter supplied at a first mid-column feed position to a distillation column in a lower region of a fractionation tower;

(5) said gaseous second stream is expanded to said lower pressure and is supplied to said distillation column at a second mid-column feed position;

(6) at least a portion of said condensed stream is expanded to said lower pressure and is supplied to said distillation column at a third mid-column feed position;

(7) a distillation stream is withdrawn from an upper region of said tower and is divided into a volatile residue gas fraction and a recycle stream;

(8) said recycle stream is compressed to form a compressed recycle stream;

(9) said compressed recycle stream is cooled with at least a portion of said volatile residue gas fraction sufficiently to substantially condense it;

(10) said substantially condensed compressed recycle stream is expanded to said lower pressure and supplied to said fractionation tower at a top feed position; and

(11) the quantity and pressure of said compressed recycle stream and the quantities and temperatures of said feed streams to the column are effective to maintain tower overhead temperature at a temperature whereby the major portion of said $C_2$ components, $C_3$ components and heavier hydrocarbon components is recovered in said relatively less volatile fraction.

72. In a process for the separation of a gas stream containing methane, $C_2$ components, $C_3$ components and heavier hydrocarbon components into a volatile residue gas fraction containing a major portion of said methane and said $C_2$ components and a relatively less volatile fraction containing a major portion of said $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_3$ components and heavier components is recovered in said relatively less volatile fraction;

the improvement wherein said gas stream is cooled sufficiently to partially condense it; and (1) said partially condensed gas stream is separated thereby to provide a vapor stream and a condensed stream;

(2) said vapor stream is thereafter divided into gaseous first and second streams;

(3) said gaseous first stream is cooled to condense substantially all of it and is thereafter expanded to said lower pressure whereby it is further cooled;

(4) said expanded cooled first stream is thereafter supplied at a first mid-column feed position to a distillation column in a lower region of a fractionation tower;

(5) said gaseous second stream is expanded to said lower pressure and is supplied to said distillation column at a second mid-column feed position;

(6) at least a portion of said condensed stream is expanded to said lower pressure and is supplied to said distillation column at a third mid-column feed position;

(7) a distillation stream is withdrawn from an upper region of amid tower and is divided into a volatile residue gas fraction and a recycle stream;

(8) said recycle stream is compressed to form a compressed recycle stream;

(9) said compressed recycle stream is cooled with at least a portion of said volatile residue gas fraction sufficiently to substantially condense it;

(10) said substantially condensed compressed recycle stream is expanded to said lower pressure and supplied to said fractionation tower at a top feed position; and

(11) the quantity and pressure of said compressed recycle stream and the quantities and temperatures of said feed streams to the column are effective to maintain tower overhead temperature at a temperature whereby the major portion of said $C_3$ components and heavier hydrocarbon components is recovered in said relatively less volatile fraction.

73. In a process for the separation of a gas stream containing methane, $C_2$ components, $C_3$ components and heavier hydrocarbon components into a volatile residue gas fraction containing a major portion of said methane and a relatively less volatile fraction containing a major portion of said $C_2$ components, $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_2$ components, $C_3$ components and heavier components is recovered in said relatively less volatile fraction;

the improvement wherein prior to cooling, said gas is divided into gaseous first and second streams; and (1) said gaseous first stream is cooled to condense substantially all of it and is thereafter expanded to said lower pressure whereby it is further cooled;

(2) said expanded cooled first stream is thereafter supplied at a first mid-column feed position to a distillation column in a lower region of a fractionation tower;

(3) said gaseous second stream is cooled under pressure sufficiently to partially condense it;

(4) said partially condensed second stream is separated thereby to provide a vapor stream and a condensed stream;

(5) said vapor stream is expanded to said lower pressure and is supplied to said distillation column at a second mid-column feed position;

(6) at least a portion of said condensed stream is expanded to said lower pressure and is supplied to said distillation column at a third mid-column feed position;

(7) a distillation stream is withdrawn from an upper region of said tower and is divided into a volatile residue gas fraction and a recycle stream;

(8) said recycle stream is compressed to form a compressed recycle stream;

(9) said compressed recycle stream is cooled with at least a portion of said volatile residue gas fraction sufficiently to substantially condense it;

(10) said substantially condensed compressed recycle stream is expanded to said lower pressure and supplied to said fractionation tower at a top feed position; and

(11) the quantity and pressure of said compressed recycle stream and the quantities and temperatures of said feed streams to the column are effective to maintain tower overhead temperature at a temperature whereby the major portion of said $C_2$ components, $C_3$ components and heavier hydrocarbon components is recovered in said relatively less volatile fraction.

74. In a process for the separation of a gas stream containing methane, $C_2$ components, $C_3$ components and heavier hydrocarbon components into a volatile residue gag fraction containing a major portion of said methane and said $C_2$ components and a relatively less volatile fraction containing a major portion of said $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_3$ components and heavier components is recovered in said relatively less volatile fraction;

the improvement wherein prior to cooling, said gas is divided into gaseous first and second streams; and (1) said gaseous first stream is cooled to condense substantially all of it and is thereafter expanded to said lower pressure whereby it is further cooled;

(2) said expanded cooled first stream is thereafter supplied at a first mid-column feed position to distillation column in a lower region of a fractionation tower;

(3) said gaseous second stream is cooled under pressure sufficiently to partially condense it;

(4) said partially condensed second stream is separated thereby to provide a vapor stream and a condensed stream;

(5) said vapor stream is expanded to said lower pressure and is supplied to said distillation column at a second mid-column feed position;

(6) at least a portion of said condensed stream is expanded to said lower pressure and is supplied to said distillation column at a third mid-column feed position;

(7) a distillation stream is withdrawn from an upper region of said tower and is divided into a volatile residue gas fraction and a recycle stream;

(8) said recycle stream is compressed to form a compressed recycle stream;

(9) said compressed recycle stream is cooled with at least a portion of said voltage residue gas fraction sufficiently to substantially condense it;

(10) said substantially condensed compressed recycle stream is expanded to said lower pressure and supplied to said fractionation tower at a top feed position; and

(11) the quantity and pressure of said compressed recycle stream and the quantities and temperatures of said feed streams to the column are effective to maintain tower overhead temperature at a temperature whereby the major portion of said $C_3$ components and heavier hydrocarbon components is recovered in said relatively less volatile fraction.

75. In a process for the separation of a gas stream containing methane, $C_2$ components, $C_3$ components and heavier hydrocarbon components into a volatile residue gas fraction containing a major portion of said methane and a relatively less volatile fraction containing a major portion of said $C_2$ components, $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_2$ components, $C_3$ components and heavier components is recovered in said relatively less volatile fraction;

the improvement wherein following cooling, said cooled stream is divided into first and second streams; and (1) said first stream is cooled to condense substantially all of it and is thereafter expanded to said lower pressure hereby it is further cooled;

(2) said expanded cooled first stream is thereafter supplied at a first mid-column feed position to a distillation column in a lower region of a fractionation tower;

(3) said second stream is cooled sufficiently to partially condense it;

(4) said partially condensed second stream is separated thereby to provide a vapor stream and a condensed stream;

(5) said vapor stream is expanded to said lower pressure and is supplied to said distillation column at a second mid-column feed position;

(6) at least a portion of said condensed stream is expanded to said lower pressure and is supplied to said distillation column at a third mid-column feed position;

(7) a distillation stream is withdrawn from an upper region of said tower and is divided into a volatile residue gas fraction and a recycle stream;

(8) said recycle stream is compressed to form a compressed recycle stream;

(9) said compressed recycle stream is cooled with at least a portion of said volatile residue gas fraction sufficiently to substantially condense it;

(10) said substantially condensed compressed recycle stream is expanded to said lower pressure and supplied to said fractionation tower at a top feed position; and

(11) the quantity and pressure of said compressed recycle stream and the quantities and temperatures of said feed streams to the column are effective to maintain tower overhead temperature at a temperature whereby the major portion of said $C_2$ components, $C_3$ components and heavier hydrocarbon components is recovered in said relatively less volatile fraction.

76. In a process for the separation of a gas stream containing methane, $C_2$ components, $C_3$ components and heavier hydrocarbon components into a volatile residue gas fraction containing a major portion of said methane and said $C_2$ components and a relatively less volatile fraction containing a major portion of said $C_3$ components and heavier components, in which process (a) said gas stream is cooled under pressure to provide a cooled stream;

(b) said cooled stream is expanded to a lower pressure whereby it is further cooled; and (c) said fur=her cooled stream is fractionated at said lower pressure whereby the major portion of said $C_3$ components and heavier components is recovered in said relatively less volatile fraction;

the improvement wherein following cooling, said cooled stream is divided into first and second streams; and (1) said first stream is cooled to condense substantially all of it and is thereafter expanded to said lower pressure whereby it is further cooled;

(2) said expanded cooled first stream is thereafter supplied at a first mid-column feed position to a distillation column in a lower region of a fractionation tower;

(3) said second stream is cooled sufficiently to partially condense it;

(4) said partially condensed second stream is separated thereby to provide a vapor stream and a condensed stream;

(5) said vapor stream is expanded to said lower pressure and is supplied to said distillation column at a second mid-column feed position;

(6) at least a portion of said condensed stream is expanded to said lower pressure and is supplied to said distillation column at a third mid-column feed position;

(7) a distillation stream is withdrawn from an upper region of said tower and is divided into a volatile residue gas fraction and a recycle stream;

(8) said recycle stream is compressed to form a compressed recycle stream;

(9) said compressed recycle stream is cooled with at least a portion of said volatile residue gas fraction sufficiently to substantially condense it;

(10) said substantially condensed compressed recycle stream is expanded to said lower pressure and supplied to said fractionation tower at a top feed position; and

(11) the quantity and pressure of said compressed recycle stream and the quantities and temperatures of said feed streams to the column are effective to maintain tower overhead temperature at a temperature whereby the major portion of said $C_3$ components and heavier hydrocarbon components is recovered in said relatively less volatile fraction.

77. In a process for the separation of a gas stream containing methane, $C_2$ components, $C_3$ components and heavier hydrocarbon components into a volatile residue gas fraction containing a major portion of said methane and a relatively less volatile fraction containing a major portion of said $C_2$ components, $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_2$ components, $C_3$ components and heavier components is recovered in said relatively less volatile fraction;

the improvement wherein prior to cooling, said gas is divided into gaseous first and second streams; and (1) said gaseous first stream is cooled to condense substantially all of it and is thereafter expanded to said lower pressure whereby it is further cooled;

(2) said expanded cooled first stream is thereafter supplied at a first mid-column feed position to a distillation column in a lower region of a fractionation tower;

(3) said gaseous second stream is cooled under pressure and then expanded to said lower pressure and supplied to said distillation column at a second mid-column feed position;

(4) a distillation stream is withdrawn from an upper region of said tower and is divided into a volatile residue gas fraction and a recycle stream;

(5) said recycle stream is compressed to form a compressed recycle stream;

(6) said compressed recycle stream is cooled with at least a portion of said volatile residue gas fraction sufficiently to substantially condense it;

(7) said substantially condensed compressed recycle stream is expanded to said lower pressure and supplied to said fractionation tower at a top feed position; and (8) the quantity and pressure of said compressed recycle stream and the quantities and temperatures of said feed streams to the column are effective to maintain tower overhead temperature at a temperature whereby the major portion of said $C_2$ components, $C_3$ components and heavier hydrocarbon components is recovered in said relatively less volatile fraction.

78. In a process for the separation of a gas stream containing methane, $C_2$ components, $C_3$ components and heavier hydrocarbon components into a volatile residue gas fraction containing a major portion of said methane and said $C_2$ components and a relatively less volatile fraction containing a major portion of said $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_3$ components and heavier components is recovered in said relatively less volatile fraction;

the improvement wherein prior to cooling, said gas is divided into gaseous first and second streams; and (1) said gaseous first stream is cooled to condense substantially all of it and is thereafter expanded to said lower pressure whereby it is further cooled;

(2) said expanded cooled first stream is thereafter supplied at a first mid-column feed position to a distillation column in a lower region of a fractionation tower;

(3) said gaseous second stream is cooled under pressure and then expanded to said lower pressure and supplied to said distillation column at a second mid-column feed position;

(4) a distillation stream is withdrawn from an upper region of said tower and is divided into a volatile residue gas fraction and a recycle stream;

(5) said recycle stream is compressed to form a compressed recycle stream;

(6) said compressed recycle stream is cooled with at least a portion of said volatile residue gas fraction sufficiently to substantially condense it;

(7) said substantially condensed compressed recycle stream is expanded to said lower pressure and supplied to said fractionation tower at a top feed position; and (8) the quantity and pressure of said compressed recycle stream and the quantities and temperatures of said feed streams to the column are effective to maintain tower overhead temperature at a temperature whereby the major portion of said $C_3$ components and heavier hydrocarbon components is recovered in said relatively less volatile fraction.

79. In a process for the separation of a gas stream containing methane, $C_2$ components, $C_3$ components and heavier hydrocarbon components into a volatile residue gas fraction containing a major portion of said methane and a relatively less volatile fraction containing a major portion of said $C_2$ components, $C_3$ components and heavier components, in which process (a) said gas stream is cooled under pressure to provide a cooled stream;

(b) said cooled stream is expended to a lower pressure whereby it is further cooled; and (c) said further cooled stream is fractionated at said lower pressure whereby the major portion of said $C_2$ components, $C_3$ components and heavier components is recovered in said relatively less volatile fraction;

the improvement wherein following cooling, said cooled stream is divided into first and second streams; and (1) said first stream is cooled to condense substantially all of it and is thereafter expanded to said lower pressure whereby it is further cooled;

(2) said expanded cooled first stream is thereafter supplied at a first mid-column feed position to a distillation column in a lower region of a fractionation tower;

(3) said second stream is expanded to said lower pressure and is supplied to said distillation column at a second mid-column feed position;

(4) a distillation stream is withdrawn from an upper region of said tower and is divided into a volatile residue gas fraction and a recycle stream;

(5) said recycle stream is compressed to form a compressed recycle stream;

(6) said compressed recycle stream is cooled with at least a portion of said volatile residue gas fraction sufficiently to substantially condense it;

(7) said substantially condensed compressed recycle stream is expanded to said lower pressure and supplied to said fractionation tower at a top feed position; and (8) the quantity and pressure of said compressed recycle stream and the quantities and temperatures of said feed streams to the column are effective to maintain tower overhead temperature at a temperature whereby the major portion of said $C_2$ components, $C_3$ components and heavier hydrocarbon components is recovered in said relatively less volatile fraction.

80. In a process for the separation of a gas stream containing methane, $C_2$ components, $C_3$ components and heavier hydrocarbon components into a volatile residue gas fraction containing a major portion of said methane and said $C_2$ components and a relatively less volatile fraction containing a major portion of said $C_3$ components and heavier components, in which process (a) said gas stream is cooled under pressure to provide a cooled stream;

(b) said cooled stream is expanded to a lower pressure whereby it is further cooled; and (c) said further cooled stream is fractionated at said lower pressure whereby the major portion of said $C_3$ components and heavier components is recovered in said relatively less volatile fraction;

the improvement wherein following cooling, said cooled stream is divided into first and second streams; and (1) said first stream is cooled to condense substantially all of it and is thereafter expanded to said lower pressure whereby it is further cooled;

(2) said expanded cooled first stream is thereafter supplied at a first mid-column feed position to a distillation column in a lower region of a fractionation tower;

(3) said second stream is expanded to said lower pressure and is supplied to said distillation column at a second mid-column feed position;

(4) a distillation stream is withdrawn from an upper region of said tower and is divided into a volatile residue gas fraction and a recycle stream;

(5) said recycle stream is compressed to form a compressed recycle stream;

(6) said compressed recycle stream is cooled with at least a portion of said volatile residue gas fraction sufficiently to substantially condense it;

(7) said substantially condensed compressed recycle stream is expanded to said lower pressure and supplied to said fractionation tower at a top feed position; and (8) the quantity and pressure of said compressed recycle stream and the quantities and temperatures of said feed streams to the column are effective to maintain tower overhead temperature at a temperature whereby the major portion of said $C_3$ components and heavier hydrocarbon components is recovered in said relatively less volatile fraction.

81. The improvement according to claims 65, 66, 67, 68, 69, 70, 71, 72, 73, 74, 75, 76, 77, 78, 79 or 80, wherein said distillation stream is warmed prior to being divided into said volatile residue gas fraction and recycle stream.

* * * * *

UNITED STATES PATENT AND TRADEMARK OFFICE

CERTIFICATE OF CORRECTION

PATENT NO. : 5,568,737

DATED : October 29, 1996

INVENTOR(S) : Campbell et al.

It is certified that error appears in the above-indentified patent and that said Letters Patent is hereby corrected as shown below:

Col. 3, line 52 "on that" should read --one that--

Col. 6, line 54, "Stream" should read --stream--

Col. 9, line 63, "stream The" should read --stream 21. The--

Col. 11, line 67, "shows" should read --show--

Col. 22, line 10, "Cs" should read --$C_3$--

Col. 24, line 4, "Of" should read --of--

Col. 41, line 29, "Cs" should read --$C_3$--

Col. 41, line 39, "gee" should read --gas--

Col. 45, line 51, "Condensed" should read --condensed--

Col. 48, line 1, "gag" should read --gas--

Col. 48, line 21, "to" should read --to a--

UNITED STATES PATENT AND TRADEMARK OFFICE

CERTIFICATE OF CORRECTION

PATENT NO. : 5,568,737
DATED : October 29, 1996
INVENTOR(S) : Campbell, et. al.

It is certified that error appears in the above-indentified patent and that said Letters Patent is hereby corrected as shown below:

Col. 49, line 55, "fur=her" should read --further--.

Signed and Sealed this

Eleventh Day of March, 1997

Bruce Lehman

*Attest:*

BRUCE LEHMAN

*Attesting Officer*

*Commissioner of Patents and Trademarks*